US010606202B2

(12) United States Patent
Matsuno et al.

(10) Patent No.: US 10,606,202 B2
(45) Date of Patent: Mar. 31, 2020

(54) IMAGE FORMING APPARATUS TO CALCULATE FILM THICKNESSES OF A PHOTOCONDUCTOR FILM OF A PHOTOCONDUCTOR, IMAGE FORMING METHOD, AND NON-TRANSITORY RECORDING MEDIUM STORING IMAGE FORMING PROGRAM

(71) Applicants: Yasuhide Matsuno, Kanagawa (JP); Takahiro Yoshimi, Tokyo (JP); Shinji Minami, Kanagawa (JP)

(72) Inventors: Yasuhide Matsuno, Kanagawa (JP); Takahiro Yoshimi, Tokyo (JP); Shinji Minami, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/183,874

(22) Filed: Nov. 8, 2018

(65) Prior Publication Data

US 2019/0146394 A1 May 16, 2019

(30) Foreign Application Priority Data

Nov. 13, 2017 (JP) ..... 2017-218226
Oct. 26, 2018 (JP) ..... 2018-201729

(51) Int. Cl.
*G03G 15/00* (2006.01)
*G03G 15/02* (2006.01)

(52) U.S. Cl.
CPC ..... *G03G 15/5033* (2013.01); *G03G 15/0266* (2013.01); *G03G 15/5037* (2013.01);
(Continued)

(58) Field of Classification Search
CPC ..... G03G 15/5033; G03G 15/553; G03G 15/0266; G03G 15/5037; G03G 15/75;
(Continued)

(56) References Cited

U.S. PATENT DOCUMENTS 5,485,248 A * 1/1996 Yano ..... G03G 15/0216 399/168
7,860,415 B2 * 12/2010 Tokuyama ..... G03G 15/0853 399/62

(Continued)

FOREIGN PATENT DOCUMENTS

JP 5-223513 8/1993
JP 8-334956 12/1996

(Continued)

*Primary Examiner* — David M. Gray
*Assistant Examiner* — Laura Roth
(74) *Attorney, Agent, or Firm* — Harness, Dickey & Pierce, P.L.C.

(57) ABSTRACT

An image forming apparatus includes a photoconductor, a charging roller to charge the photoconductor, a power source to apply a charging bias to the charging roller, a current sensor to generate a feedback signal representing an output current flowing from the charging roller to the photoconductor, a memory, and circuitry. The circuitry calculates film thicknesses of a photoconductor film of the photoconductor at a plurality of points of time based on a voltage of the charging bias and the output current, calculates travel distances of the photoconductor charged at the plurality of points of time, associates the film thicknesses with the travel distances, stores the film thicknesses and the travel distances in the memory, calculates a present estimated film thickness based on the film thicknesses and the travel distances, and calculates an estimated film thickness range corresponding to a present travel distance based on the present estimated film thickness.

20 Claims, 11 Drawing Sheets

(52) U.S. Cl.
CPC ..... *G03G 15/553* (2013.01); *G03G 15/751* (2013.01); *G03G 2215/00071* (2013.01)

(58) Field of Classification Search
CPC ..... G03G 15/751; G03G 2215/00071; G03G 2215/00075
See application file for complete search history.

(56) References Cited

U.S. PATENT DOCUMENTS

| | | | | |
|---|---|---|---|---|
| 2013/0266332 | A1 | 10/2013 | Miyazaki et al. | |
| 2014/0161471 | A1 | 6/2014 | Matsuno et al. | |
| 2015/0139674 | A1 | 5/2015 | Sugiyama et al. | |
| 2015/0234348 | A1 | 8/2015 | Fujita et al. | |
| 2017/0075264 | A1* | 3/2017 | Kanatani ..... | G03G 15/1665 |
| 2017/0255122 | A1 | 9/2017 | Minami | |
| 2018/0081312 | A1* | 3/2018 | Hirota ..... | G03G 15/5037 |
| 2018/0173131 | A1* | 6/2018 | Tsutsumi ..... | G03G 15/0291 |

FOREIGN PATENT DOCUMENTS

| | | |
|---|---|---|
| JP | 2001-304849 | 10/2001 |
| JP | 2004-145169 | 5/2004 |
| JP | 2009-098279 | 5/2009 |
| JP | 2010-072553 | 4/2010 |
| JP | 2014-178593 | 9/2014 |

* cited by examiner

IMAGE FORMING APPARATUS TO CALCULATE FILM THICKNESSES OF A PHOTOCONDUCTOR FILM OF A PHOTOCONDUCTOR, IMAGE FORMING METHOD, AND NON-TRANSITORY RECORDING MEDIUM STORING IMAGE FORMING PROGRAM

CROSS-REFERENCE TO RELATED APPLICATIONS

This patent application is based on and claims priority pursuant to 35 U.S.C. § 119 to Japanese Patent Applications No. 2017-218226, filed on Nov. 13, 2017 and No. 2018-201729, filed on Oct. 26, 2018 in the Japanese Patent Office, the entire disclosure of which is hereby incorporated by reference herein.

BACKGROUND

Technical Field

The present disclosure relates to an image forming apparatus, an image forming method, and a non-transitory recording medium storing an image forming program.

Description of the Related Art

Conventionally, an electrophotographic image forming apparatus performs a charging process in which the surface of a photoconductor is uniformly charged. Typically, a direct-current (DC) contact charging method is employed as the charging process. In the DC contact charging method, a charging roller applied a DC voltage contacts the surface of the photoconductor, and discharge between the charging roller and the surface of the photoconductor occurs and charges the surface of the photoconductor to a target electric potential.

In the DC contact charging method, the charging roller contacts the surface of the photoconductor. Accordingly, as the photoconductor rotates, the charging roller scrapes a photoconductor film on the surface of the photoconductor. Over time, as the photoconductor film becomes thinner, the relation between the voltage applied to the charging roller and the surface potential of the photoconductor changes, and the surface potential of the photoconductor required for proper image formation cannot be maintained and it becomes necessary to replace the photoconductor.

Additionally, if the photoconductor film is entirely scraped off, charging performance sharply deteriorates because holding a charge on the surface of the photoconductor becomes impossible. Therefore, it is necessary to replace the photoconductor.

To counter these problems, a conventional image forming apparatus uses rotations of a photoconductor to calculate a scraping amount of the thickness of a photoconductor film of the photoconductor, which is also referred to as the film thickness of the photoconductor, and controls the voltage applied to a charging roller or determines the life of the photoconductor. But the film thickness of the photoconductor estimated by using rotations of the charged photoconductor may greatly differ from the actual film thickness of the photoconductor depending on (1) usage environment, (2) pressure of a blade that abuts the photoconductor in a photoconductor unit, and (3) nip pressure in a developing unit.

SUMMARY

This specification describes an improved image forming apparatus that includes a rotatable photoconductor, a charging roller to charge a surface of the photoconductor, a power source to apply a charging bias to the charging roller, a current sensor to generate a feedback signal representing an output current flowing from the charging roller to the photoconductor, a memory, and circuitry. The circuitry calculates film thicknesses of a photoconductor film of the photoconductor at a plurality of points of time based on a voltage of the charging bias applied to the charging roller and the output current flowing to the photoconductor, calculates travel distances of the photoconductor charged by the charging roller at the plurality of points of time, associates the film thicknesses with the travel distances, stores the film thicknesses and the travel distances in the memory, calculates a present estimated film thickness based on the film thicknesses and the travel distances acquired from the memory, and calculates an estimated film thickness range corresponding to a present travel distance based on the present estimated film thickness.

This specification further describes an improved image forming method of an image forming apparatus including a rotatable photoconductor, a charging roller to charge a surface of the photoconductor, a power source to apply a charging bias to the charging roller, and a current sensor to generate a feedback signal representing an output current flowing from the charging roller to the photoconductor. The image forming method includes calculating film thicknesses of a photoconductor film of the photoconductor at a plurality of points of time based on a voltage of the charging bias applied to the charging roller and the output current flowing to the photoconductor, calculating travel distances of the photoconductor charged by the charging roller at the plurality of time, associating the film thicknesses with the travel distances, storing the film thicknesses and the travel distances, calculating a present estimated film thickness based on the film thicknesses and the travel distances, and calculating an estimated film thickness range corresponding to a present travel distance based on the present estimated film thickness.

This specification still further describes a non-transitory computer-readable recording medium with an executable program code stored thereon, wherein the program code, when executed, instructs an image forming apparatus to execute the image forming method described above.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
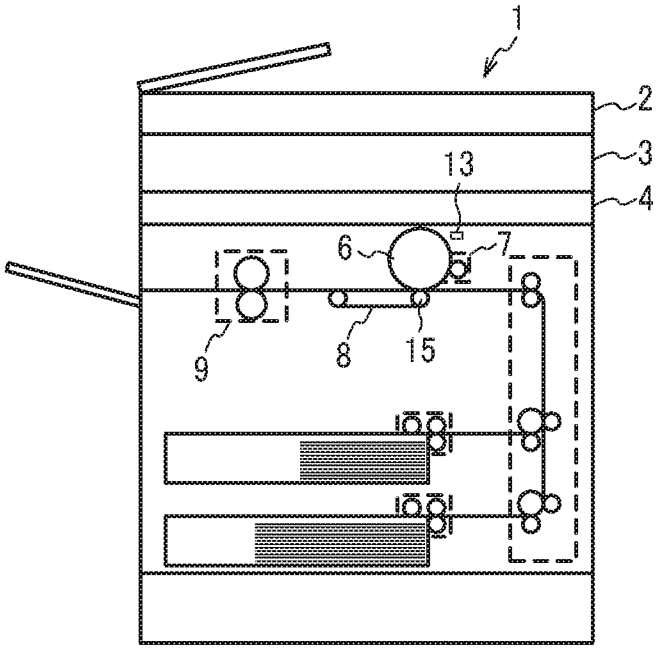
FIG. 1 is a schematic diagram illustrating a configuration of an image forming apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements (members or components) having the same function or shape and redundant descriptions thereof are omitted below.

To accurately calculate a film thickness range of a photoconductor corresponding to a present travel distance for an estimated film thickness, the present disclosure includes the following structure.

That is, an image forming apparatus according to an embodiment of the present disclosure includes a rotatable photoconductor, a charging roller to charge a surface of the photoconductor, a power source to apply a charging bias to the charging roller, a current sensor to generate a feedback signal representing an output current flowing from the charging roller to the photoconductor, a memory, and circuitry. The circuitry calculates film thicknesses of a photoconductor film of the photoconductor at a plurality of points of time based on a voltage of the charging bias applied to the charging roller and the output current flowing to the photoconductor, calculates travel distances of the photoconductor charged by the charging roller at the plurality of points of time, associates the film thicknesses with the travel distances, stores the film thicknesses and the travel distances in the memory, calculates a present estimated film thickness based on the film thicknesses and the travel distances acquired from the memory, and calculates an estimated film thickness range corresponding to a present travel distance based on the present estimated film thickness.

The above-described structure can accurately calculate the film thickness range of the photoconductor corresponding to the present travel distance for the estimated film thickness.

Elements, types, combinations and shapes of elements, and relative positions of components in the embodiments are examples only and do not limit the scope of the appended claims.

First Embodiment

FIG. 1 is a schematic diagram illustrating a configuration of an image forming apparatus according to an embodiment of the present disclosure.

With reference to FIG. 1, image formation in a copy mode in the image forming apparatus 1 is briefly described as an example.

In the copy mode, an automatic document feeder (ADF) 2 in the image forming apparatus 1 sequentially feeds a document in a bundle of documents to an image reading device 3, and the image reading device 3 reads image data of the document. The image data read by the image reading device 3 is processed by an image processor and converted to optical information by a writing unit 4. A photoconductor 6 is a photoconductor drum and uniformly charged by a charger. Based on the optical information from the writing unit 4, the charged photoconductor 6 is exposed by an exposure unit 13 to form an electrostatic latent image.

A developing device 7 develops the electrostatic latent image on the photoconductor 6 into a toner image. The toner image is transferred onto a sheet by a transfer roller 15, and the sheet is conveyed by conveyance belt 8. The toner image is fixed on the sheet by the fixing unit 9, and the sheet is ejected.

<Electrophotographic Process in Image Forming Apparatus According to the First Embodiment>

Figure 2:
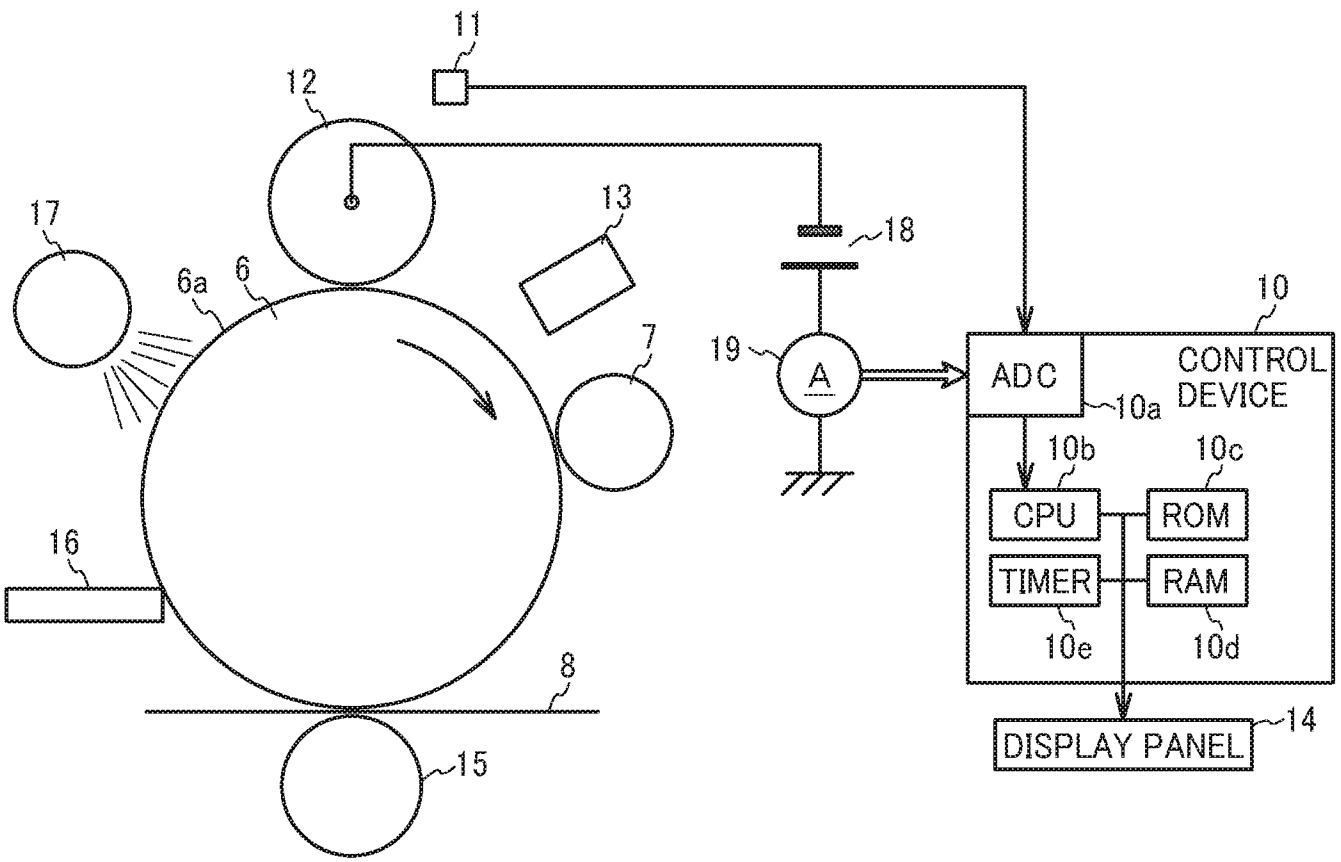
FIG. 2 is a schematic diagram illustrating an electrophotographic process executed in the image forming apparatus according to the first embodiment of the present disclosure.

FIG. 2 is a schematic diagram illustrating an overall configuration of an electrophotographic process in the image forming apparatus according to the first embodiment of the present disclosure.

FIG. 2 illustrates the configuration of the electrophotographic process including the general direct DC charging process and includes the photoconductor 6, the charging roller 12, the exposure unit 13, the developing device 7, a display panel 14, the transfer roller 15, a cleaning blade 16, a discharger 17, a high voltage power source 18 for charging, a current voltage sensor 19, and a control device 10.

The photoconductor 6 rotates, and a direct current high voltage generated by the high voltage power source 18 is applied to the charging roller 12 to uniformly charge the surface of the photoconductor 6. After the charging roller 12 uniformly charges the surface of the photoconductor 6, the exposure unit 13 irradiates the photoconductor 6 with image light corresponding to the image signal, and the surface of the photoconductor 6 is exposed by the image light to form an electrostatic latent image on the surface of the photoconductor 6.

The developing device 7 develops the latent image on the surface of the photoconductor 6 into a toner image, and the transfer roller 15 transfers the toner image on the photoconductor 6 onto a recording medium. Thereafter, the toner image is fixed on the recording medium by the fixing unit 9. Thus, the image is formed on the recording medium.

The discharger 17 irradiates the surface of the photoconductor 6 with LED light and removes electric charges remaining on the surface of the photoconductor 6. Subsequently, the charging roller 12 charges the photoconductor 6 for next image forming processes.

The control device 10 includes an analog-to-digital (A/D) converter (ADC) 10*a*, a central processing unit (CPU) 10*b*, a read only memory (ROM) 10*c*, and a random-access memory (RAM) 10*d*.

The display panel 14 displays a usage rate of the photoconductor 6 at a value between 0 and 100%.

<Control Device>

Figure 3:
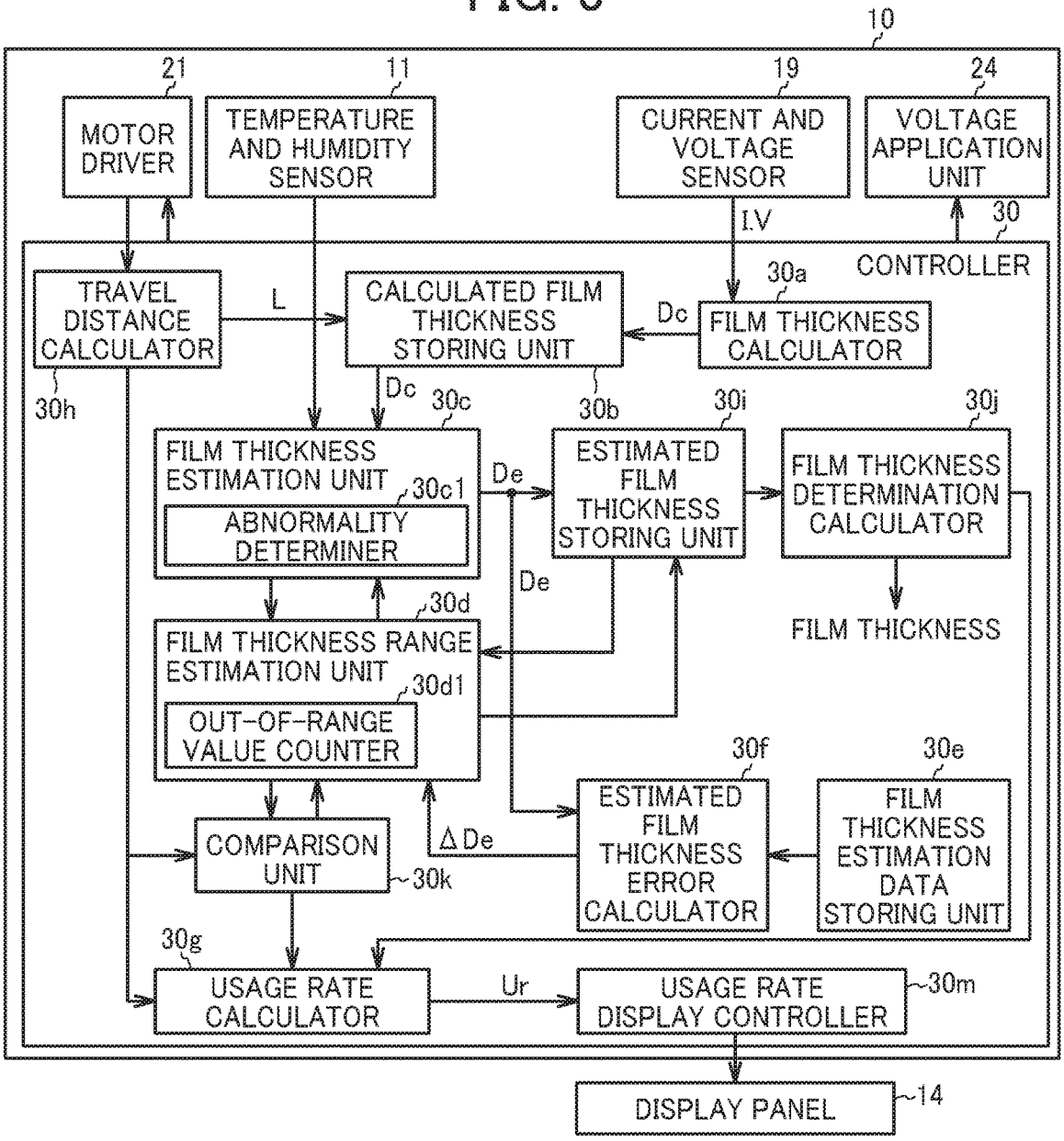
FIG. 3 is a diagram illustrating a configuration of a control device of the image forming apparatus according to the first embodiment of the present disclosure.

FIG. 3 is a diagram illustrating a configuration of the control device 10 according to the first embodiment of the present disclosure. In addition to the ADC 10*a*, CPU 10*b*, ROM 10*c*, and RAM 10*d* described above, the control device 10 illustrated in FIG. 3 includes a motor driver 21, a temperature and humidity sensor 11, a current and voltage sensor 19, a voltage application unit 24, and a controller 30.

The motor driver 21 drives a motor in accordance with drive instructions from the controller 30 to rotate the photoconductor 6 according to the rotation of the motor.

The temperature and humidity sensor 11 detects ambient temperature and humidity around the photoconductor 6.

The voltage application unit 24 acquires a voltage command that indicates a voltage to be applied to the photoconductor 6 from the controller 30, controls an output voltage from the high voltage power source 18 so that the voltage to be applied to the photoconductor 6 corresponds to the voltage command, and applies the output voltage to the photoconductor 6 via the charging roller 12.

The current and voltage sensor 19 generates a feedback signal representing the output current or output voltage flowing from the charging roller 12 to the photoconductor 6 and outputs the feedback signal to the A/D converter 10*a*.

The control device 10 illustrated in FIG. 2 is, for example, a microcomputer including the CPU 10*b*, the ROM 10*c*, and the RAM 10*d* as described above.

The CPU 10*b* illustrated in FIG. 2 reads an operating system (OS) from the ROM 10*c*, expands the OS on the RAM 10*d*, and boots up the OS. Then, under the management of the OS, the CPU 10*b* reads a program (a processing module) of the application software from the ROM 10*c* and executes various processes, thereby implementing the controller 30 illustrated in FIG. 3.

The controller 30 includes a film thickness calculator 30*a*, a calculated film thickness storing unit 30*b*, a film thickness estimation unit 30*c*, an abnormality determiner 30*c*1, a film thickness range estimation unit 30*d*, an out-of-range value counter 30*d*1, a film thickness estimation data storing unit 30*e*, an estimated film thickness error calculator 30*f*, a usage rate calculator 30*g*, a comparison unit 30*k*, a travel distance calculator 30*h*, an estimated film thickness storing unit 30*i*, and a film thickness determination calculator 30*j*.

The film thickness calculator 30*a* calculates a slope of I-V characteristics of the photoconductor 6 based on the output current flowing to the photoconductor 6 and the output voltage that is a charging bias applied to the charging roller 12 and, based on the slope of the I-V characteristics, calculates a film thickness.

The calculated film thickness storing unit 30*b* associates the calculated film thickness which is calculated by the film thickness calculator 30*a* with a travel distance calculated by the travel distance calculator 30*h* and stores the calculated film thickness and the travel distance in the RAM 10*d*.

The film thickness estimation unit 30*c* calculates a present estimated film thickness based on the calculated film thickness and the travel distance at the plurality of points of time acquired from the calculated film thickness storing unit 30*b*. Using a least square method, the film thickness estimation unit 30*c* calculates the estimated film thickness corresponding to the present travel distance based on the calculated film thicknesses and the travel distances at the plurality of points of time acquired from the calculated film thickness storing unit 30*b*.

The estimated film thickness error calculator 30*f* calculates an estimated film thickness error ΔDe based on the temperature and humidity detected by the temperature and humidity sensor 11.

The film thickness range estimation unit 30*d* calculates a film thickness range from Dmin to Dmax based on the estimated film thickness error ΔDe and the estimated film thickness which is estimated by the film thickness estimation unit 30*c*.

The film thickness range estimation unit 30*d* calculates the film thickness range from Dmin to Dmax based on the estimated film thickness and the estimated film thickness error ΔDe.

The film thickness range estimation unit 30*d* calculates the film thickness range from Dmin to Dmax to be narrower as the previous estimated film thickness value is smaller.

The film thickness range estimation unit 30*d* calculates the film thickness range from Dmin to Dmax corresponding to the present travel distance by using the estimated film thickness error ΔDe based on the previous estimated film thickness.

In the next film thickness estimation, the abnormality determiner 30*c*1 determines whether the estimated film thickness is valid or invalid based on whether the estimated film thickness falls within the film thickness range from Dmin to Dmax estimated by the film thickness range estimation unit 30*d*.

The abnormality determiner 30*c*1 determines that the estimated film thickness is invalid when the estimated film thickness is greater than the film thickness range higher limit value Dmax in the film thickness range from Dmin to Dmax estimated by the film thickness range estimation unit 30*d*.

The out-of-range value counter 30*d*1 counts an out-of-range count that is a number of times the estimated film thickness is continuously outside the film thickness range. When the out-of-range count becomes equal to or greater than a predetermined number of times, the abnormality determiner 30*c*1 determines that the estimated film thickness smaller than the film thickness range lower limit value Dmin is valid.

When the estimated film thickness becomes valid, the abnormality determiner 30*c*1 discards the calculated film thicknesses Dc which are stored in the calculated film thickness storing unit 30*b* before the calculated film thickness Dc becomes lower than the film thickness range lower limit value Dmin.

When the out-of-range count continuously counted by the out-of-range value counter 30*d*1 is less than the predetermined number of times, the abnormality determiner 30*c*1 causes the film thickness estimation unit 30*c* to perform this film thickness estimation process again.

The out-of-range value counter 30*d*1 counts out-of-range count when the estimated film thickness is greater than the maximum film thickness Dmax of the film thickness range from Dmin to Dmax estimated by the film thickness range estimation unit 30*d* or when the estimated film thickness is smaller than the minimum film thickness Dmin of the film thickness range from Dmin to Dmax estimated by the film thickness range estimation unit 30*d*.

The out-of-range value counter 30*d*1 is included in the film thickness range estimation unit 30*d*.

The film thickness estimation data storing unit 30*e* stores film thickness error estimation data used by the estimated film thickness error calculator 30*f*.

The estimated film thickness error calculator 30*f* calculates an estimated film thickness error ΔDe at the estimated film thickness based on the film thickness error estimation data and the estimated film thickness.

The comparison unit 30*k* compares the film thickness range lower limit value Dmin estimated by the film thickness range estimation unit 30*d* and the maximum wearing film thickness obtained when a photoconductor film 6*a* on the surface of the photoconductor 6 is scraped to the maximum. The maximum wearing film thickness can be calculated based on the travel distance of the photoconductor 6.

The usage rate calculator 30*g* calculates the usage rate of the photoconductor 6 as the comparison result of the comparison unit 30*k* based on the larger of the film thickness range lower limit value and the maximum scrape film thickness value.

The usage rate calculator 30*g* calculates the usage rate of the photoconductor 6 based on the film thickness range lower limit value estimated by the film thickness range estimation unit 30*d*.

The travel distance calculator 30*h* calculates a travel distance of the charged photoconductor 6 by multiplying number of rotation per second with a charge application time measured by a timer 10*e*. The timer 10*e* measures time while the motor that rotates the photoconductor 6 rotates, the voltage application unit 24 applies voltage to the charging roller 12, and the charging roller 12 charges the photoconductor 6.

The usage rate display controller 30*m* converts the usage rate of the photoconductor 6 calculated by the usage rate calculator 30*g* into a value between 0 and 100% and displays the value on the display panel 14.

The estimated film thickness storing unit 30*i* adds validity or invalidity which is determined regarding the estimated film thickness by the abnormality determiner 30*c*1 to the estimated film thickness estimated by the film thickness estimation unit 30*c* and saves the estimated film thickness and the validity or invalidity.

The film thickness determination calculator 30*j* determines the film thickness that is the estimated film thickness added the validity and stored in the estimated film thickness storing unit 30*i* and outputs the film thickness.

The controller 30 calculates the voltage to be applied to the photoconductor 6 based on the feedback signal generated by the current and voltage sensor 19 via the A/D converter 10*a*, transmits the voltage as the voltage command to the voltage application unit 24, and controls adjustment of the applied voltage.

<I-V Characteristics Detection>

Under the control of the controller 30, a plurality of different voltages is applied to the photoconductor 6 to charge the photoconductor 6, currents when the voltages are applied are detected, the I-V characteristics is calculated, and the film thickness is detected from the slope of the I-V characteristics.

The control device 10 applies the plurality of different voltages and detects the charging current when the voltages are applied through the A/D converter 10*a* to derive the I-V characteristics when the photoconductor 6 is charged.

The following description is an example of derivation of the I-V characteristics. Four different voltages as a plurality of voltages are applied to the photoconductor 6 in a plurality of steps of the control. The steps of the control are the following steps ST1 to ST5.

In step ST1, the control device 10 applies a charging voltage V1 to the photoconductor 6 and detects the charging current I1 at that time.

In step ST2, the control device 10 applies a charging voltage V2 to the photoconductor 6 and detects the charging current I2 at that time.

In step ST3, the control device 10 applies a charging voltage V3 to the photoconductor 6 and detects the charging current I3 at that time.

In step ST4, the control device 10 applies a charging voltage V4 to the photoconductor 6 and detects the charging current I4 at that time.

Figure 6:
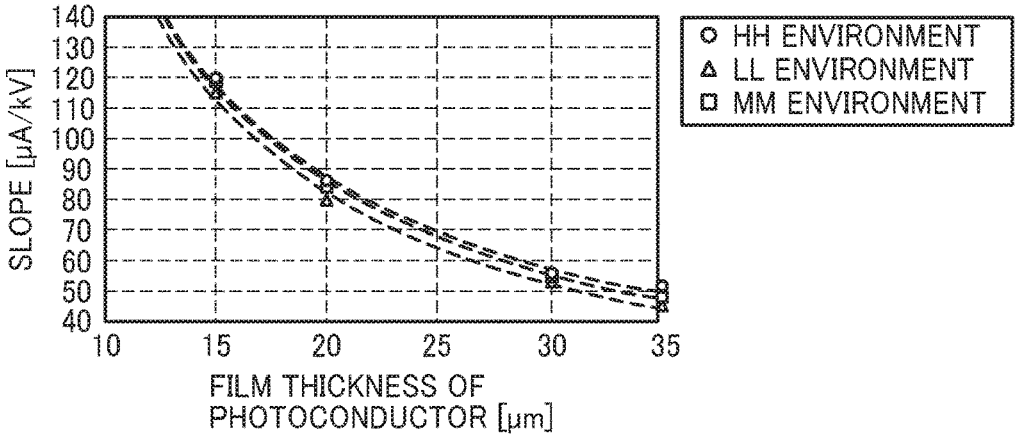
FIG. 6 is a graph illustrating a relation between film thickness of a photoconductor and slope of the I-V characteristics of the photoconductor at different temperatures and humidity.

In step ST5, after executions from step ST1 to step ST4, the film thickness calculator 30*a* deprives the I-V characteristics from the charging voltages and the detected currents, deprives the slope of the I-V characteristics (see FIG. 4), and calculates the film thickness D of the photoconductor 6 corresponding to the slope m of the I-V characteristics (see FIG. 6).

The calculated film thickness storing unit 30*b* associates the present travel distance L calculated by the travel distance calculator 30*h* with the film thickness D calculated by the film thickness calculator 30*a* and stores the present travel distance L and the film thickness D in the RAM 10*d*.

The voltages V1 to V4 are different voltages. The calculated film thickness storing unit 30*b* may have at least two points of a plurality of different current-voltage pairs (I1, V1) to (I4, V4).

<I-V Characteristics Graph>

Figure 4:
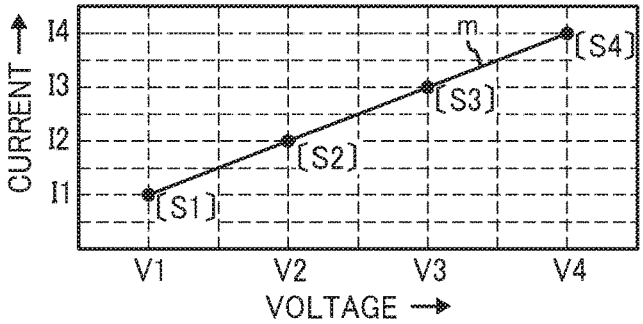
FIG. 4 is a graph illustrating characteristics of charging current and charging voltage, that is, I-V characteristics.

FIG. 4 is a graph illustrating the I-V characteristics.

The film thickness calculator 30*a* obtains the calculated thickness of the photoconductor film 6*a* based on the slope m of the IV characteristic graph illustrated in FIG. 4.

Specifically, when the charging roller 12 charges the photoconductor 6, the current Idc flowing between the charging roller 12 and the photoconductor 6 and the film thickness D of a photoconductor layer of the photoconductor 6 holds the following equation, Idc=K/D (K is a constant).

As described above, the film thickness calculator 30*a* calculates the slope m of the I-V characteristics of the photoconductor 6 based on the charging current flowing to the photoconductor 6 and the charging voltage that is the charging bias applied to the charging roller 12 and calculates the film thickness based on the slope m of the I-V characteristics.

<I-V Characteristics Under Noisy Environment>

Figure 5:
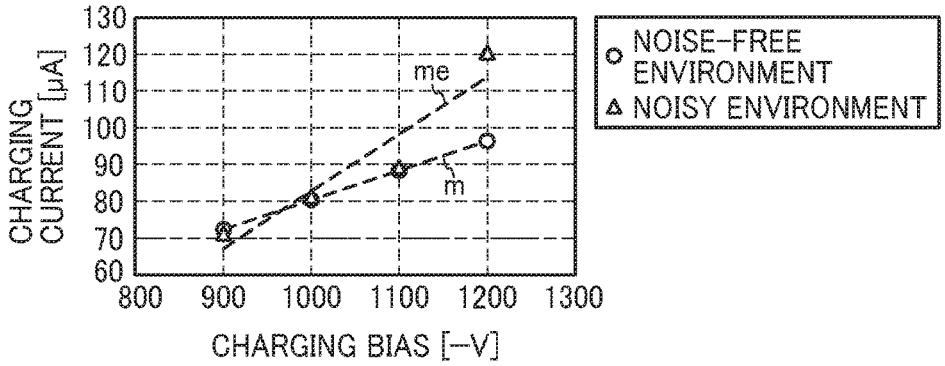
FIG. 5 is a graph including I-V characteristics under a noisy environment.

FIG. 5 is a graph including I-V characteristics under noisy environment.

In FIG. 5, circle marks represent the I-V characteristics under noise-free environment, and triangle marks represent the I-V characteristics under noisy environment.

In the above-described steps ST1 to ST5, the slope m of the I-V characteristics is calculated, and the film thickness D can be calculated from the slope m.

However, as illustrated in FIG. 5, abnormal I-V characteristics caused by noise causes a problem that a miscalculated slope me results in a miscalculated film thickness De.

<Relation Between Slope and the Film Thickness at Different Temperatures and Humidities>

FIG. 6 is a graph illustrating a relation between the film thickness and the slope m of the I-V characteristics of the photoconductor at different temperatures and humidity.

Ideally, the relation between the slope m of the I-V characteristics and the film thickness is constant. However, as illustrated in FIG. 6, an error of the film thickness in a low temperature and low humidity that is referred as LL environment (for example, 10° C., 15%) becomes larger than that in a moderate temperature and moderate humidity that is referred as MM environment (for example, 23° C., 50%) and a high temperature and high humidity that is referred as HH environment (for example, 27° C., 80%).

The film thickness of the new photoconductor is about 34 μm, and the film thickness determined to require replacement is, for example, 13 μm.

In this film thickness detection control, the film thickness is obtained from the slope m of the I-V characteristics given by some charging biases.

In the relation between the film thicknesses and the slopes m of the I-V characteristics illustrated in FIG. 6, the thinner the film, the larger the slope. As illustrated in FIG. 5, when a variation under noisy environment gives a large slope m, the calculated thickness of the photoconductor film 6*a* is thinner than the actual film thickness.

This means that the abnormal I-V characteristics calculated under the influence of the temperature and humidity environment and noise causes an unexpected end of life of the photoconductor if the image forming apparatus determines the photoconductor is spent when the detected film thickness becomes thinner than the smallest film thickness threshold Dref that ensures charging of the surface of the photoconductor.

<Outline of Film Thickness Estimation Process>

Figure 7:
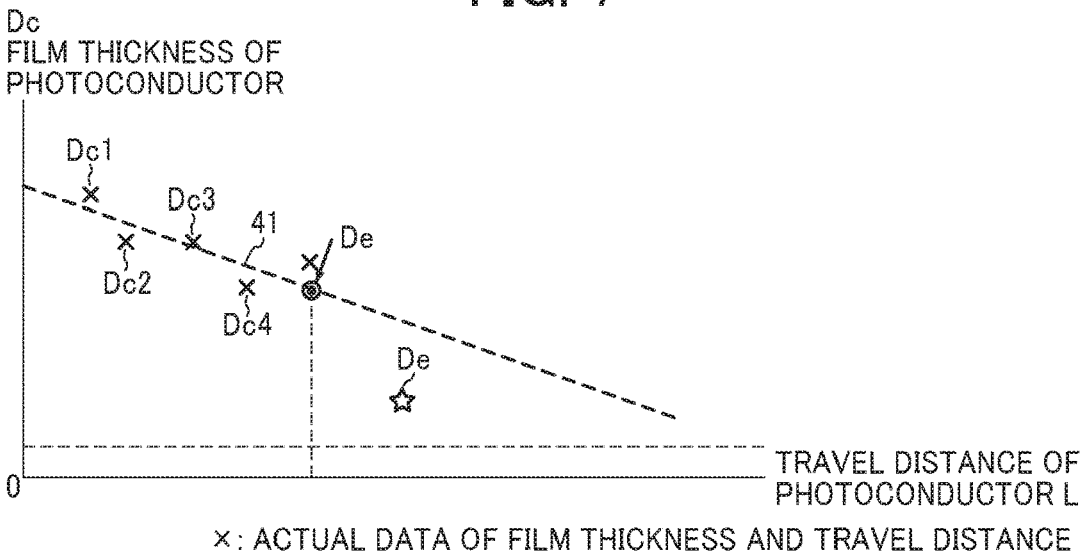
FIG. 7 is a graph illustrating an outline of a film thickness estimation process performed by a film thickness estimation unit of the image forming apparatus according to the first embodiment of the present disclosure.

FIG. 7 is a graph illustrating an outline of the film thickness estimation process performed by the film thickness estimation unit 30*c* of the image forming apparatus 1 according to the first embodiment of the present disclosure.

In FIG. 7, the vertical axis represents the calculated film thickness Dc of the photoconductor 6 and the horizontal axis represents the travel distance L of the photoconductor 6.

The calculated film thickness storing unit 30*b* saves the calculated film thickness values Dc which are calculated in the past by the film thickness calculator 30*a* and the travel distances L of the photoconductor calculated by the travel distance calculator 30*h* which are associated with each other, and the film thickness estimation unit 30*c* calculates a slope m and an intercept of a line 41 in FIG. 7 which is calculated from the calculated film thicknesses Dc with respect to the travel distances L of the photoconductor.

Based on these calculations, the film thickness estimation unit 30*c* can obtain the estimated film thickness De at the travel distance L of the photoconductor.

Based on the calculated film thicknesses Dc acquired from the calculated film thickness storing unit 30*b*, the film thickness estimation unit 30*c* calculates an approximate expression of the calculated film thicknesses Dc with respect to the travel distances L of the photoconductor by using, for example, a least squares method or the like and obtains the estimated film thickness De on the line 41 illustrated in FIG. 7.

Using the least square method, the film thickness estimation unit 30*c* calculates the estimated film thickness De corresponding to the present travel distance L based on the calculated film thicknesses Dc and the travel distances L at the plurality of points of time, which improves estimation accuracy of the estimated film thickness De.

<Influence of Variation on Calculated Film Thickness of Photoconductor>

Figure 8:
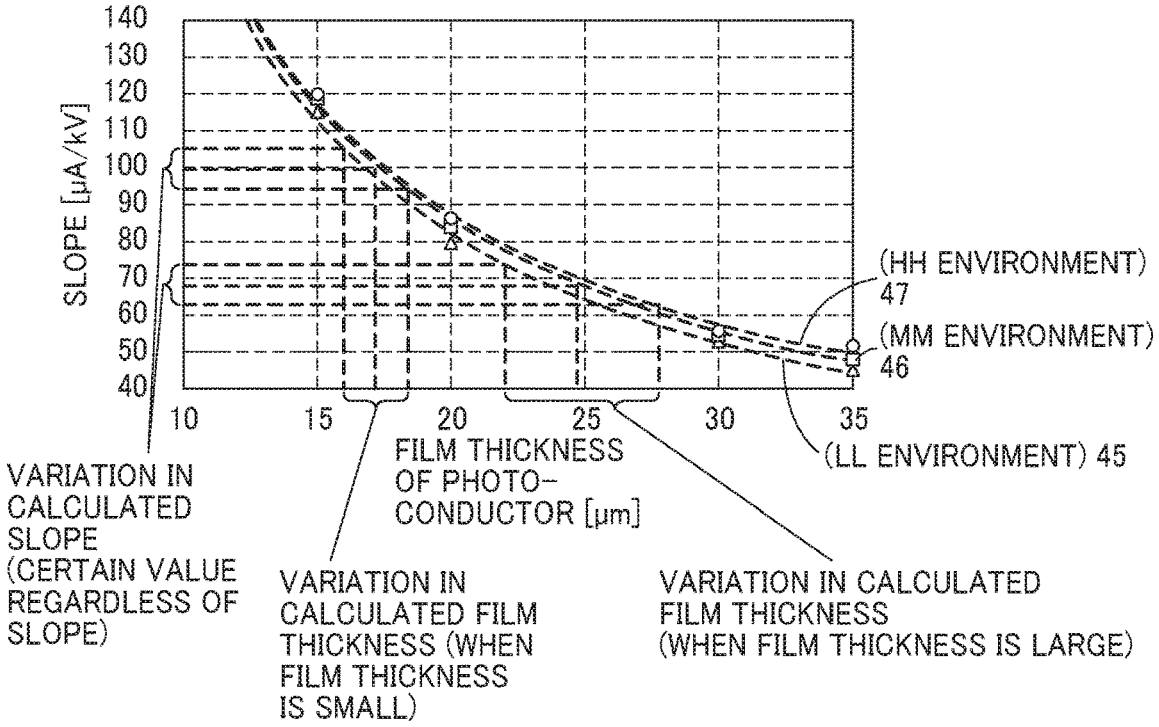
FIG. 8 is a graph illustrating a change of variation in the thickness of the photoconductor film calculated by a film thickness calculator.

FIG. 8 is a graph illustrating an outline of the influence of variation in the calculated film thickness Dc of the photoconductor calculated by the film thickness calculator 30*a*.

As illustrated in FIG. 8, a variation in slopes m of the I-V characteristics affects the calculated film thicknesses Dc.

Main factors that cause the variation of the slope m are as follows.

(1) A variation of the output voltages V that is the charging bias (2) A variation of detection values of the charging currents I (3) A variation in resistances between the photoconductor 6 and the charging roller 12

A range between the upper and lower limit in the variation of the slope m which is caused by these factors depends on a hardware element such as a circuit board that outputs the charging bias and the photoconductor 6. Therefore, the range is uniquely determined depending on the model of the image forming apparatus 1. The range between the upper and lower limit in the variation of the slope m hardly depends on the calculated slope m itself and may be regarded as a constant value. This range between the upper and lower limit enables calculation of variation in calculated film thickness Dc (See FIG. 8).

When the calculated slope m is large, that is, the calculated film thickness Dc is small, the variation in the calculated film thickness Dc due to the variation in the slope becomes small as derived by lines 45 to 47 in FIG. 8.

On the other hand, when the calculated slope m is small, that is, the calculated film thickness Dc is large, the variation in the calculated film thickness Dc due to the variation in the slope becomes large as derived by lines 45 to 47 in FIG. 8.

As described above, the range of variation of the calculated film thickness Dc depends on the calculated film thickness Dc itself and can be determined based on the calculated film thickness Dc.

Since the relation between the slope m and the calculated film thickness Dc varies depending on the temperature and humidity environment, in FIG. 8, the range of variation is determined based on environmental influences. Therefore, detecting the current temperature and humidity using the temperature and humidity sensor 11 and correcting the regression of the slope m and the calculated film thickness Dc can reduce the range of variation.

Using the same theory as the variation of the calculated film thickness Dc, based on the estimated film thickness De, the estimated film thickness error calculator 30*f* calculates the estimated film thickness error ΔDe corresponding to the estimated film thickness De which is obtained by the film thickness estimation unit 30*c* (see FIG. 7). For example, when the estimated film thickness error De is defined by a linear function as described below, the coefficient α and the intercept β can be determined based on measured data peculiar to the model of the image forming apparatus 1.

$$\Delta De = \alpha \times De + \beta \quad (1)$$

The film thickness estimation unit 30*c* corrects the estimated film thickness De based on the temperature and humidity detected by the temperature and humidity sensor 11. This gives an advantage that the estimation accuracy of the estimated film thickness De is improved.

The estimated film thickness error calculator 30*f* corrects the estimated film thickness error ΔDe based on the temperature and humidity detected by the temperature and humidity sensor 11. This gives an advantage that the estimation accuracy of the estimated film thickness error ΔDe is improved.

The film thickness range estimation unit 30*d* calculates the film thickness range upper limit Dmax and the film thickness range lower limit Dmin, which represent the range that the present film thickness can take, by the following expressions (2) and (3).

To calculate the film thickness range upper limit Dmax, the film thickness range estimation unit 30*d* adds the estimated film thickness error ΔDe to the estimated film thickness De, multiplies the minimum wear speed Vsmin by a travel distance (Ln−Le), and subtracts the multiplied value Vsmin×(Ln−Le) from the added value De+ΔDe. The minimum wear speed Vsmin is the minimum wear per unit travel distance.

$$Dmax = De + \Delta De - Vsmin \times (Ln - Le) \quad (2)$$

On the other hand, to calculate the film thickness range lower limit Dmin, the film thickness range estimation unit 30*d* subtracts the estimated film thickness error ΔDe from the estimated film thickness De, multiplies the maximum wear speed Vsmax by a travel distance (Ln−Le), and subtracts the multiplied value Vsmax×(Ln−Le) from the subtracted value De−ΔDe.

$$Dmax = De - \Delta De - Vsmax \times (Ln - Le) \quad (3)$$

In the above, the travel distance (Ln−Le) from the previous film thickness estimation time is a value obtained by subtracting the previous travel distance Le from the present travel distance Ln.

The film thickness range estimation unit 30*d* calculates the film thickness range from Dmin to Dmax, which corresponds to the present travel distance, based on the estimated film thickness calculated by the film thickness estimation unit 30*c*. This enables high accurate calculation of the film thickness range.

The film thickness range estimation unit 30*d* calculates the film thickness range from Dmin to Dmax based on the estimated film thickness De and the estimated film thickness error ΔDe. This causes the small estimated film thickness error ΔDe in the film thickness estimation when the estimated film thickness De is thin and gives advantage that the estimation accuracy of the film thickness range Dmin to Dmax is improved.

The minimum wear speed Vsmin and the maximum wear speed Vsmax described above mean the minimum and maximum wear per unit travel distance at which the film thickness of the photoconductor can be worn. Both the minimum wear speed Vsmin and the maximum wear speed Vsmax are determined as values unique to the model of the image forming apparatus 1, and mainly affected by following factors.

(1) Pressure of the cleaning blade 16

(2) Pressing force in a developing nip, that is, the pressing force in which a developing roller press the photoconductor 6

(3) Environment (In a low-temperature environment, the cleaning blade 16 becomes hard and scrapes the photoconductor 6 more.)

<Film Thickness Range>

Figure 9:
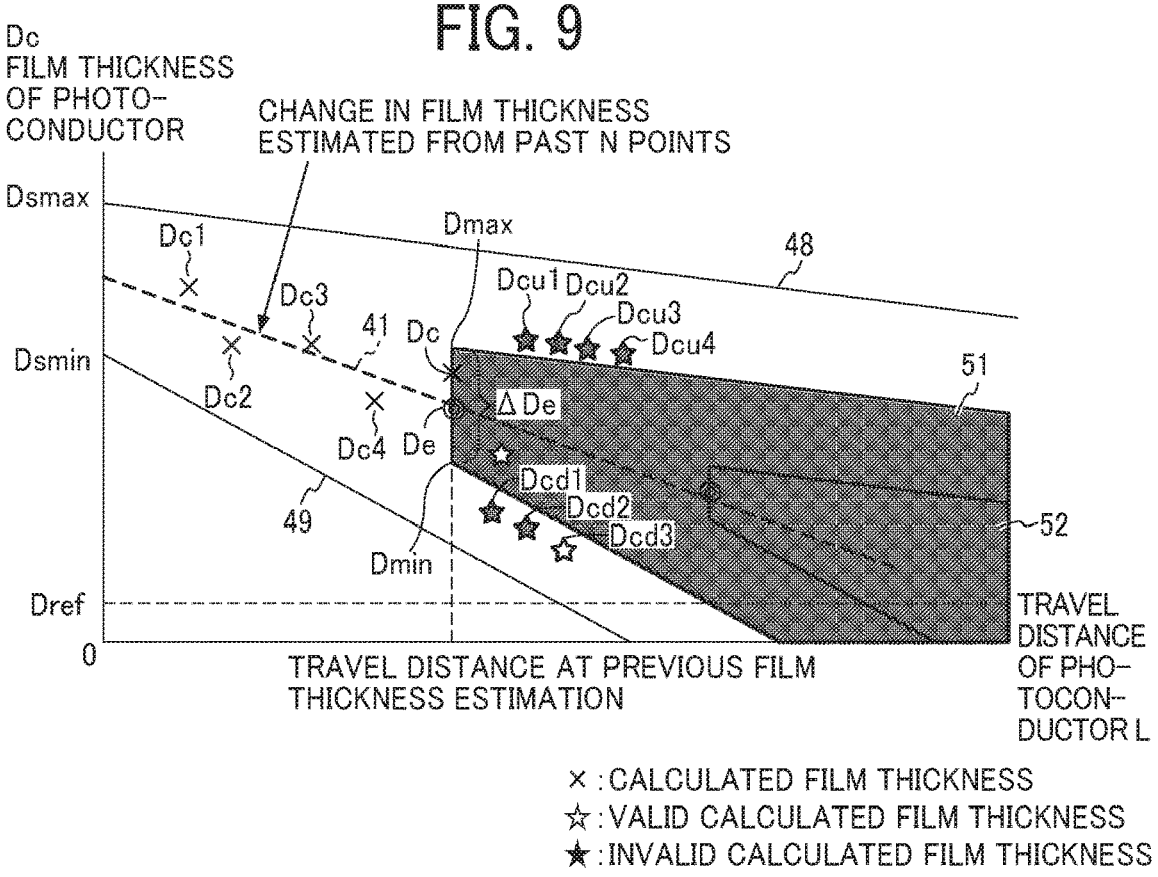
FIG. 9 is a graph illustrating an outline of a film thickness range estimation when the film thickness of the photoconductor film is estimated.

FIG. 9 is a graph illustrating an outline of a film thickness range Dmin to Dmax when the film thickness of the photoconductor is estimated.

In general, the thickness of the photoconductor film of the photoconductor 6 is given an allowable range of ±10% of the initial film thickness. Therefore, the 110% of the initial film thickness is defined as an initial maximum film thickness Dsmax, and the 90% of the initial film thickness is defined as an initial minimum film thickness Dsmin. The initial maximum film thickness Dsmax and the initial minimum film thickness Dsmin are the initial values that can be the calculated film thickness Dc of the photoconductor and are plotted on the vertical axis in FIG. 9. The smallest film thickness threshold Dref that can avoid the occurrence of abnormality is on the lower area of the vertical axis in FIG. 9.

A line 48 in FIG. 9 illustrates a transition of a case in which the film thickness is the thickest. In other words, the line 48 represents the transition when the photoconductor 6 is scraped off from the initial maximum film thickness Dsmax at the minimum wear speed Vsmin.

A line 49 in FIG. 9 illustrates a transition of a case in which the film thickness is the thinnest. In other words, the line 49 represents a transition when the photoconductor 6 is scraped off from the initial minimum film thickness Dsmin at the maximum wear speed Vsmax.

A film thickness range 51 illustrated in FIG. 9 is estimated as a range from the film thickness range upper limit Dmax to the film thickness range lower limit Dmin. The film thickness range 51 varies depending on the estimated film thickness De.

In the present embodiment, for example, when there are the calculated film thicknesses Dcu1 to Dcu4 illustrated in FIG. 9 which exceed the film thickness range upper limit Dmax of the film thickness range 51, the calculated film thicknesses Dcu1 to Dcu4 are ignored.

On the other hand, for example, when the calculated film thicknesses Dcd1 to Dcd3 illustrated in FIG. 9 which are smaller than the film thickness range lower limit Dmin in the predicted film thickness range 51 are continuously calculated in three times, the calculated film thicknesses Dcd3 at three times is determined as valid.

From the above-described expressions (2), (3), and the theory illustrated in FIG. 8, as the estimated film thickness De becomes smaller, the estimated film thickness error becomes small, and the film thickness range Dmin to Dmax becomes narrow.

Therefore, as illustrated in FIG. 9, as the thickness of the photoconductor film 6*a* of the photoconductor 6 wears out, and the estimated film thickness De decreases, that is, as the travel distance L of the photoconductor 6 increases, the film thickness estimation accuracy can be improved.

FIG. 9 illustrates an outline of an abnormality determination process performed on the estimated film thickness De of the photoconductor 6. The vertical axis represents the calculated film thickness Dc of the photoconductor 6 and the horizontal axis represents the travel distance L of the photoconductor 6.

As illustrated in FIG. 9, in the film thickness range 51 obtained from the estimated film thickness De, the film thickness range Dmin to Dmax at the travel distance L becomes narrow as the travel distance L of the photoconductor increases and the estimated film thickness De becomes smaller. That is, the predicted film thickness ranges Dmin to Dmax become narrower from the film thickness range 51 to the next range 52. As a result, it is possible to accurately calculate the film thickness range Dmin to Dmax at the present travel distance.

As the previous estimated film thickness De is smaller, the film thickness range estimation unit 30*d* calculates the narrower film thickness range from Dmin to Dmax.

This causes the small estimated film thickness error ΔDe in the film thickness estimation when the estimated film thickness De is thin and gives advantage that the estimation accuracy of the film thickness range Dmin to Dmax is improved.

<Abnormality Determination Process>

With reference to FIG. 9, an abnormality determination process is described when the film thickness calculator 30*a* calculates the calculated film thickness Dc outside the film thickness range 51.

When the film thickness calculator 30*a* calculates that the calculated film thickness Dc exceeds the film thickness range upper limit value Dmax, the abnormality determiner 30*c*1 determines that the calculated film thickness Dc is invalid. The calculation result that the calculated film thickness is thicker than a real film thickness leads to an incorrect determination that the photoconductor 6 is not actually scraped.

Therefore, when the control device 10 determines the life of the photoconductor 6 based on the calculated film thickness, the determination that the calculated film thickness Dc thicker than the film thickness range upper limit value Dmax is invalid avoids the risk of the incorrect determination described above.

Conversely, when the film thickness calculator 30*a* calculates that the calculated film thickness Dc is less than the film thickness range lower limit value Dmin, the abnormality determiner 30*c*1 firstly determines that the calculated film thickness Dc is invalid.

However, if the real film thickness value is smaller than the film thickness range lower limit value Dmin, late determination of the real film thickness and delay of feedback to the control process causes an abnormal image.

Therefore, immediately after the calculated film thickness Dc becomes less than the film thickness range lower limit value Dmin, the controller 30 detects the film thickness again and determines whether the result that the calculated film thickness Dc is less than the film thickness range lower limit value Dmin is true or error.

The out-of-range value counter 30*d*1 counts the number of times the calculated film thickness Dc becomes less than the film thickness range lower limit value Dmin, that is, an out-of-range count. When the calculated film thickness Dc continuously becomes less than the film thickness range lower limit value Dmin and the out-of-range count becomes more than a predetermined number of times, for example, three times, the controller 30 determines the real film thickness becomes thin and changes the determination regarding the calculated film thickness Dc which is less than the film thickness range lower limit value Dmin from invalid to valid.

The calculated film thicknesses Dc before the calculated film thickness Dc becomes less than the film thickness range lower limit value Dmin leads to the moderate slope m to estimate the estimated film thickness De, which may cause the problem that the estimated film thickness De becomes thicker than the real film thickness. Therefore, the calculated film thicknesses Dc calculated in the past other than the calculated film thickness Dc less than the film thickness range lower limit value Dmin should be discarded.

When the out-of-range count continuously counted by the out-of-range value counter 30*d*1 becomes more than or equal to a predetermined number of times, that is, when the state in which the estimated film thickness becomes greater than the film thickness range upper limit value or smaller than the film thickness range lower limit value continuously occurs more than or equal to the predetermined number of times, the film thickness estimation process may be not as reliable as it should be. Therefore, the controller 30 may not use the estimated film thickness De after the out-of-range count continuously counted by the out-of-range value counter 30*d*1 becomes more than or equal to the predetermined number of time and avoids the problem described above.

<Main Process>

Figure 10:
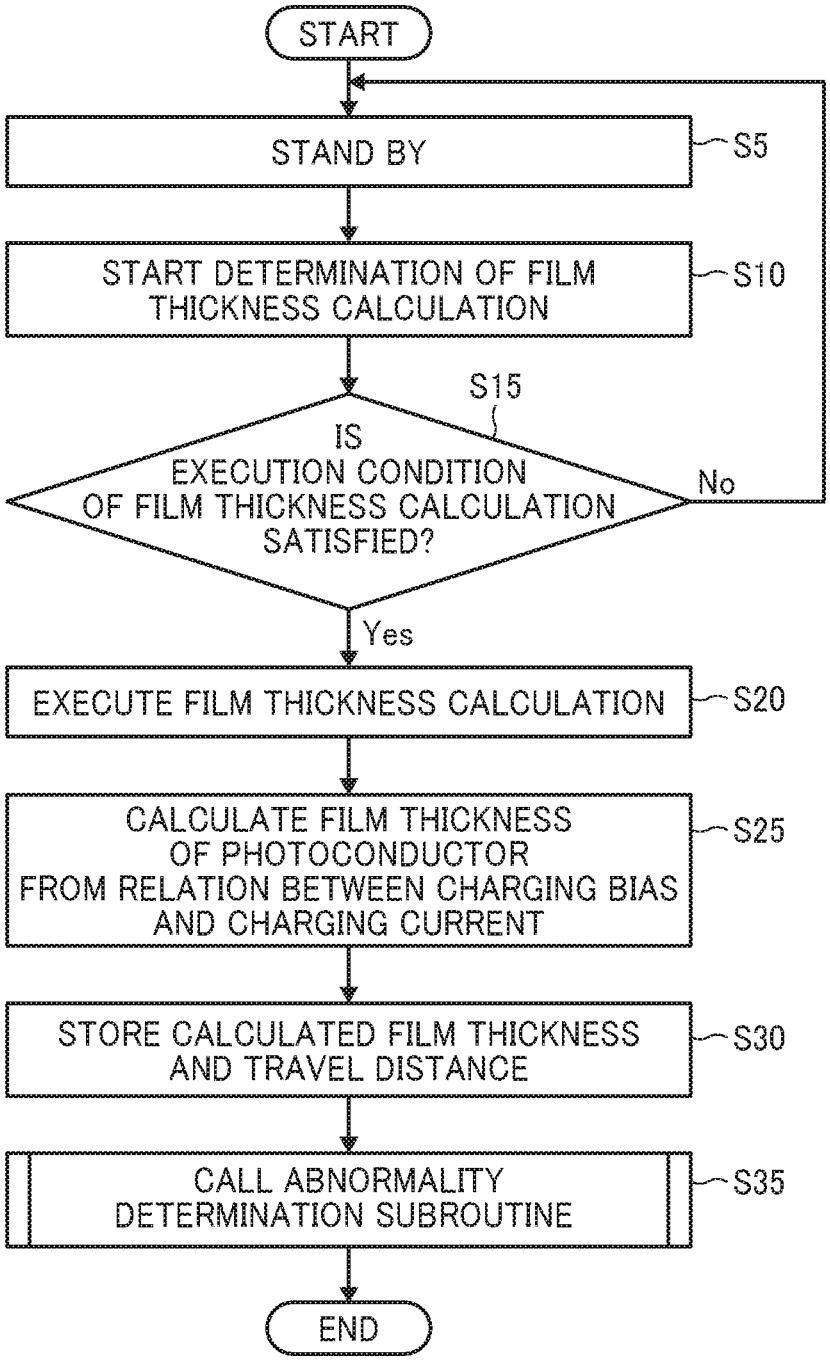
FIG. 10 is a flowchart illustrating a main process of an image forming apparatus according to the first embodiment of the present disclosure.

FIG. 10 is a flowchart illustrating a main process of the image forming apparatus 1 according to the first embodiment of the present disclosure.

In step S5, the controller 30 stands by for the film thickness calculation.

In step S10, the controller 30 starts the determination of film thickness calculation.

In step S15, the controller 30 determines whether the execution condition of film thickness calculation is satisfied. When the execution condition of film thickness calculation is satisfied (Yes in step S15), the process advances to step S20. On the other hand, when the execution condition is not satisfied (No in step S15), the process returns to step S10.

In step S20, the controller 30 executes the film thickness calculation. That is, the controller 30 outputs the voltage command indicating the voltages to be applied to the photoconductor 6 to the voltage application unit 24. The voltage application unit 24 controls output voltages from the high voltage power source 18 so that the voltages to be applied to the photoconductor 6 correspond to the voltage command and applies the output voltages to the photoconductor 6 via the charging roller 12.

In step S25, the film thickness calculator 30*a* calculates the calculated film thickness Dc from the relation between the charging bias and the charging current.

In step S30, the calculated film thickness storing unit 30*b* stores the calculated film thickness Dc and the travel distance L.

Figure 11:
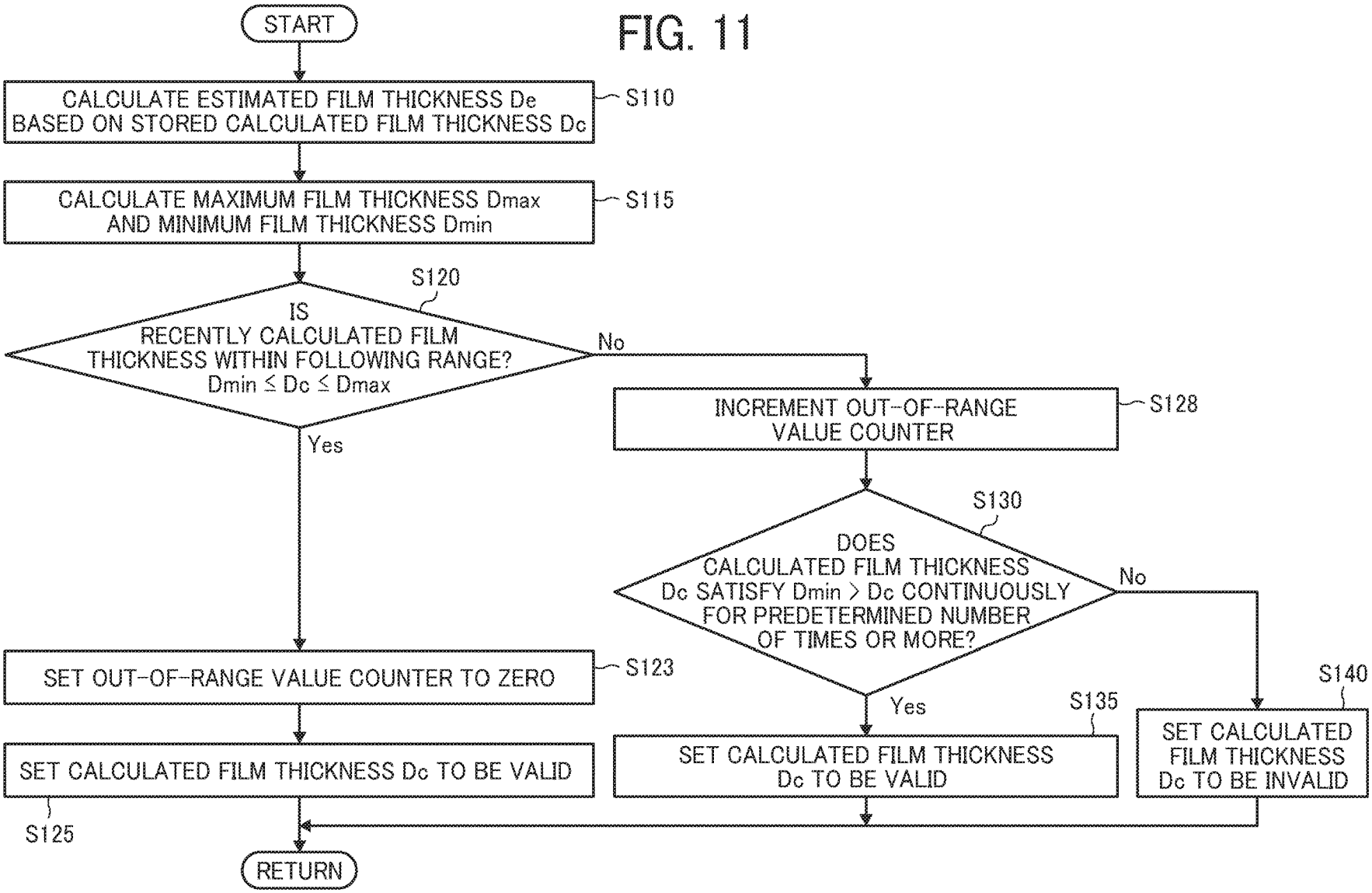
FIG. 11 is a flowchart of a sub-routine process of an abnormality determination process performed by an abnormality determiner of the image forming apparatus according to the first embodiment of the present disclosure.

In step S35, the controller 30 calls a sub-routine of the abnormality determination process illustrated in FIG. 11.

<Abnormality Determination Process>

FIG. 11 is a flowchart of the sub-routine process illustrating the abnormality determination process performed by the abnormality determiner 30*c*1 of the image forming apparatus 1 according to the first embodiment of the present disclosure.

As described above, based on the previous calculated film thickness Dc, the abnormality determiner 30*c*1 determines whether the calculated film thickness Dc falls within the film thickness range from Dmin to Dmax and whether the calculated film thickness Dc is invalid or valid.

In step S110, the film thickness estimation unit 30*c* estimates the present estimated film thickness De based on the calculated film thickness Dc acquired from the calculated film thickness storing unit 30*b*. In step S110, using a least square method, the film thickness estimation unit 30*c* estimates the present estimated film thickness De based on the calculated film thicknesses Dc at the plurality of points of time acquired from the calculated film thickness storing unit 30*b*.

In step S115, the film thickness range estimation unit 30*d* calculates the film thickness range upper limit value Dmax based on the expression (2) and calculates the film thickness lower limit value Dmin based on the expression (3).

In step S120, the abnormality determiner 30*c*1 determines whether the latest calculated film thickness Dc falls within the following range from Dmin to Dmax.

$$Dmin \leq \text{the latest calculated film thickness } Dc \leq Dmax \quad (4)$$

In the next film thickness estimation, the abnormality determiner 30*c*1 determines whether the calculated film thickness Dc is valid or invalid based on whether the calculated film thickness Dc falls within the film thickness range from Dmin to Dmax. This determination regarding validity of the calculated film thickness improves the accuracy of the estimated film thickness De, which can improve the accuracy of the next film thickness estimation.

When the latest calculated film thickness Dc falls within the range of the above expression (4), the out-of-range value counter 30*d*1 sets the successively counted value K to zero, that is, K=0, in step S123, as an initialization process.

Subsequently, in step S125, the abnormality determiner 30*c*1 determines that the latest calculated film thickness Dc is valid, and the process returned to the main routine.

When the latest calculated film thickness Dc does not fall within the range of the above expression (4), the out-of-range value counter 30*d*1 increments the successively counted value K, that is, K=K+1 in step S128.

Subsequently, in step S130, the abnormality determiner 30*c*1 determines whether the successively counted value K of the out-of-range value counter 30*d*1 is equal to or greater than the predetermined value and the calculated film thicknesses Dc continuously satisfy the following expression (5).

$$Dmin > \text{the latest calculated film thickness } Dc \quad (5)$$

When the latest calculated film thicknesses Dc satisfy the above-described conditions, in step S135, the abnormality determiner 30*c*1 determines that the latest calculated film thickness Dc is valid, and the process returned to the main routine.

The abnormality determiner 30*c*1 determines that the calculated film thicknesses Dc smaller than the film thickness range lower limit value Dmin is valid when the out-of-range count K continuously counted by the out-of-range value counter 30*d*1 becomes equal to or greater than a predetermined number of times. That is, the abnormality determiner 30*c*1 determines that the film of the photoconductor 6 is really scraped off when the calculated film thicknesses Dc is smaller than the film thickness range lower limit value Dmin. This determination causes this control to avoid the occurrence of the abnormal image, which means a safety side control.

When the calculated film thicknesses Dc become valid, the abnormality determiner 30*c*1 discards the calculated film thicknesses stored in the calculated film thickness storing unit 30*b* before the calculated film thickness Dc becomes lower than the film thickness range lower limit value Dmin. This discard prevents the result that the estimated film thickness calculated based on the past calculated film thicknesses Dc becomes a thick film thickness.

In image formation control, the abnormality determiner 30*c*1 does not use the estimated film thickness which is estimated by the film thickness estimation unit 30*c* when the out-of-range count continuously counted by the out-of-range value counter 30*d*1 becomes less than the predetermined number of times. This avoids the disadvantage of occurrence of an abnormal state that is caused by use of the invalid calculated film thicknesses.

When the latest calculated film thickness Dc does not satisfy the above-described condition (5), in step S140, the abnormality determiner 30*c* determines that the latest calculated film thickness Dc is invalid, and the process returned to the main routine.

The abnormality determiner 30*c*1 determines that the calculated film thickness Dc is invalid when the calculated film thickness Dc is greater than the film thickness range higher limit value Dmax in the film thickness range from Dmin to Dmax estimated by the film thickness range estimation unit 30*d*. This prevents the disadvantage due to the abnormal image that is caused by wrong determination regarding the end of life of the photoconductor.

When the out-of-range count, for the film thickness range from Dmin to Dmax which is estimated by the film thickness range estimation unit 30*d*, continuously counted by the out-of-range value counter 30*d*1 is less than the predetermined number of times, the abnormality determiner 30*c*1 causes the film thickness estimation unit 30*c* to perform the film thickness estimation process again. This enables to early determine whether the abnormality in the calculated film thickness Dc is true or not.

<Effect of First Embodiment>

In the first embodiment, to determine whether the calculated film thickness Dc is normal or abnormal, the control device 10 stores the travel distance L of the photoconductor and the estimated film thickness De in the past film thickness estimation and calculates the future film thickness range for the estimated film thickness De based on the minimum and maximum wear speed of the film thickness and a range of the lower and upper limit calculated from the estimated film thickness error ΔDe that is a function of the estimated film thickness De.

The film thickness range from Dmin to Dmax varies depending on the previous estimated film thickness De. As the film becomes thinner, calculation accuracy of the film thickness becomes better, which enables determination regarding the abnormality in the film thickness detection result and high accurate calculation of the estimated film thickness De.

Second Embodiment

In the first embodiment, since the relation between the slope m of the I-V characteristics and the calculated film thickness Dc varies depending on temperature and humidity as well as noise, the range of variation regarding the film thickness of the photoconductor is determined based on the environmental influences as illustrated in FIG. 8.

In contrast, in a second embodiment, detecting the present temperature and humidity using the temperature and humidity sensor 11 and correcting the regression of the slope m and the calculated film thickness Dc reduces the range of variation.

Using the same theory as the variation of the calculated film thickness Dc, based on the estimated film thickness De, the estimated film thickness error calculator 30*f* can provide the estimated film thickness error ΔDe corresponding to the estimated film thickness De which is obtained based on FIG. 9.

For example, when the estimated film thickness error is defined by a linear function like a following expression (11), the estimated film thickness error ΔDe, the coefficient α, the estimated film thickness De and the intercept β can be determined based on measured data peculiar to the model of the image forming apparatus 1. The coefficient α and the intercept β are examples of the film thickness error estimation data.

$$\Delta De=\alpha\times De+\beta \quad (11)$$

The lower limit value of the film thickness, that is, the film thickness range lower limit value Dmin can be calculated by the following expression (12) in a calculation of the usage rate of the photoconductor.

To calculate the film thickness range lower limit Dmin, the film thickness range estimation unit 30*d* subtracts the estimated film thickness error ΔDe from the estimated film thickness De, multiplies the maximum wear speed Vsmax by a travel distance (Ln−Le), and subtracts the multiplied value Vsmax×(Ln−Le) from the subtracted value De−ΔDe.

$$Dmin=De-\Delta De-Vsmax\times(Ln-Le) \quad (12)$$

The maximum wear speed Vsmax means the maximum speed, that is, the maximum wear per unit travel distance at which the film thickness of the photoconductor wears. The maximum wear speed Vsmax is determined as the value unique to the model of the image forming apparatus 1, and mainly affected by following factors.

(1) Pressure of the cleaning blade 16

(2) Pressing force in a developing nip, that is, the pressing force in which a developing roller press the photoconductor 6

(3) Environment (In a low-temperature environment, the cleaning blade 16 becomes hard and scrapes the photoconductor 6 more.)

<Outline of Usage Rate Calculation Process>

Figure 12:
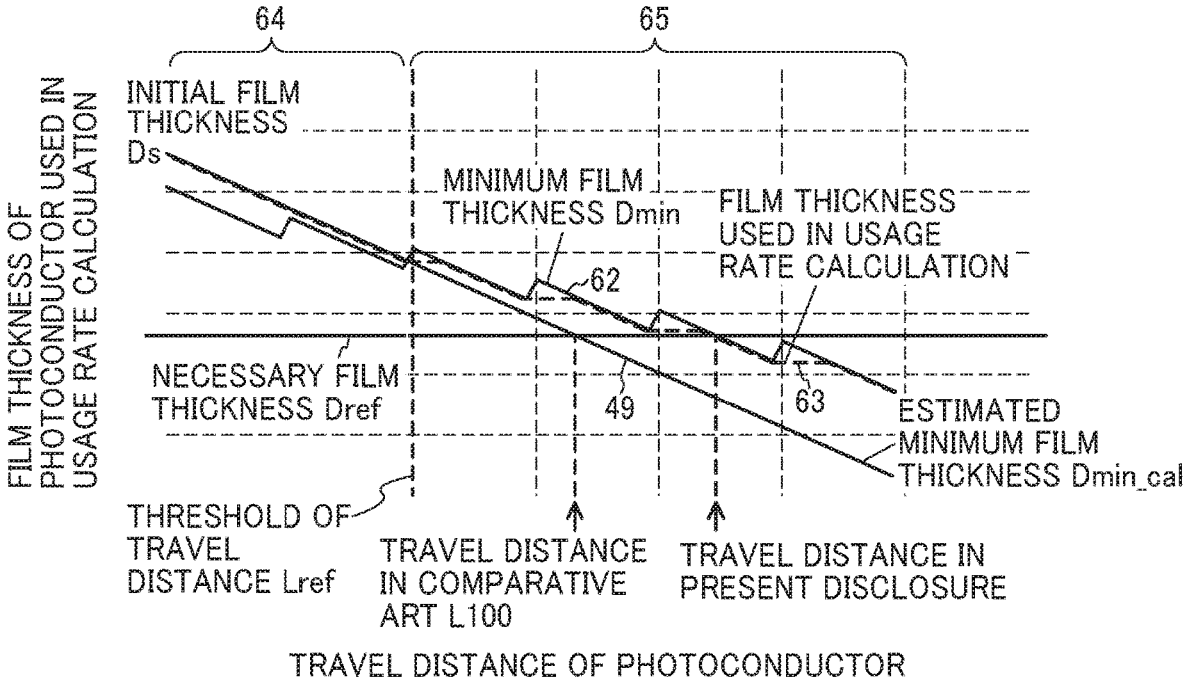
FIG. 12 is a graph illustrating an outline of usage rate calculation process adopted in the image forming apparatus according to a second embodiment of the present disclosure.

FIG. 12 is a graph illustrating an outline of usage rate calculation process adopted in the image forming apparatus 1 according to a second embodiment of the present disclosure.

In the present second embodiment, the usage rate calculator 30*g* calculates the usage rate by using the film thickness range lower limit value Dmin as illustrated in FIG. 12 to avoid prematurely determining that the photoconductor is spent, caused by use of erroneous data.

In FIG. 12, the horizontal axis represents the travel distance L of the photoconductor to calculate the usage rate Ur in the life determination of the photoconductor, and the vertical axis represents the estimated film thickness De of the photoconductor.

There is a comparative example in which the usage rate (%) is calculated based on an estimated minimum film thickness Dmin_cal 49 shaved from initial thickness of the photoconductor film 6*a* of the photoconductor 6 at the assumed maximum wear speed Vsmax.

The estimated minimum film thickness Dmin_cal is calculated by subtracting a value obtained by multiplying the maximum wear speed Vsmax by the travel distance L of the photoconductor from the initial film thickness Ds as the following expression (13).

$$Dmin_cal=Ds-Vsmax\times L \quad (13)$$

In the second embodiment, the film thickness range estimation unit 30*d* calculates the film thickness range lower limit value Dmin based on the estimated film thickness De which is estimated at the previous film thickness estimation, and the usage rate calculator 30*g* calculates the usage rate Ur based on the film thickness range lower limit value Dmin, which gives high accurate usage rate Ur in each film thickness estimation.

The film thickness range lower limit value Dmin is illustrated by a line 62 in FIG. 12.

The comparison unit 30*k* compares the estimated minimum film thickness Dmin_cal and the film thickness range lower limit value Dmin, and, when the film thickness range lower limit value Dmin is smaller than the estimated minimum film thickness Dmin_cal, that is, Dmin<Dmin_cal, which is illustrated as a range 64 in FIG. 12, the usage rate calculator 30*g* calculates the usage rate Ur based on the estimated minimum film thickness Dmin_cal.

On the other hand, when the film thickness range lower limit value Dmin is greater than the estimated minimum film thickness Dmin_cal, that is, Dmin>Dmin_cal, which is illustrated as a range 65 in FIG. 12, the usage rate calculator 30*g* calculates the usage rate Ur based on the film thickness range lower limit value Dmin.

As described above, using the larger one of the estimated minimum film thickness Dmin_cal and the film thickness range lower limit value Dmin for calculation in the usage rate Ur can improve accuracy of the usage rate Ur and determination of the photoconductor life. This is because the actual thickness of the photoconductor film 6*a* of the photoconductor 6 does not become smaller than the maximum wearing film thickness.

When influence of noise may make the film thickness range lower limit value Dmin that is the line 62 in FIG. 12, the usage rate calculator 30*g* does not use the film thickness range lower limit value Dmin for the calculation of usage rate of the photoconductor 6.

As the photoconductor 6 wears out, the accuracy of the estimated film thickness error ΔDe in the above expression (12) is improved.

A film thickness used in the calculation of the usage rate Ur is illustrated as a line 63 in FIG. 12.

As the travel distance L of the photoconductor 6 increases and the film becomes thinner, the accuracy of the film thickness estimation becomes better.

Therefore, in the second embodiment, after the travel distance L of the photoconductor exceeds a predetermined threshold value, the film thickness estimation of the photoconductor and the calculation of the usage rate Ur is executed, which improves the accuracy.

<Usage Rate Calculation Process>

Figure 13:
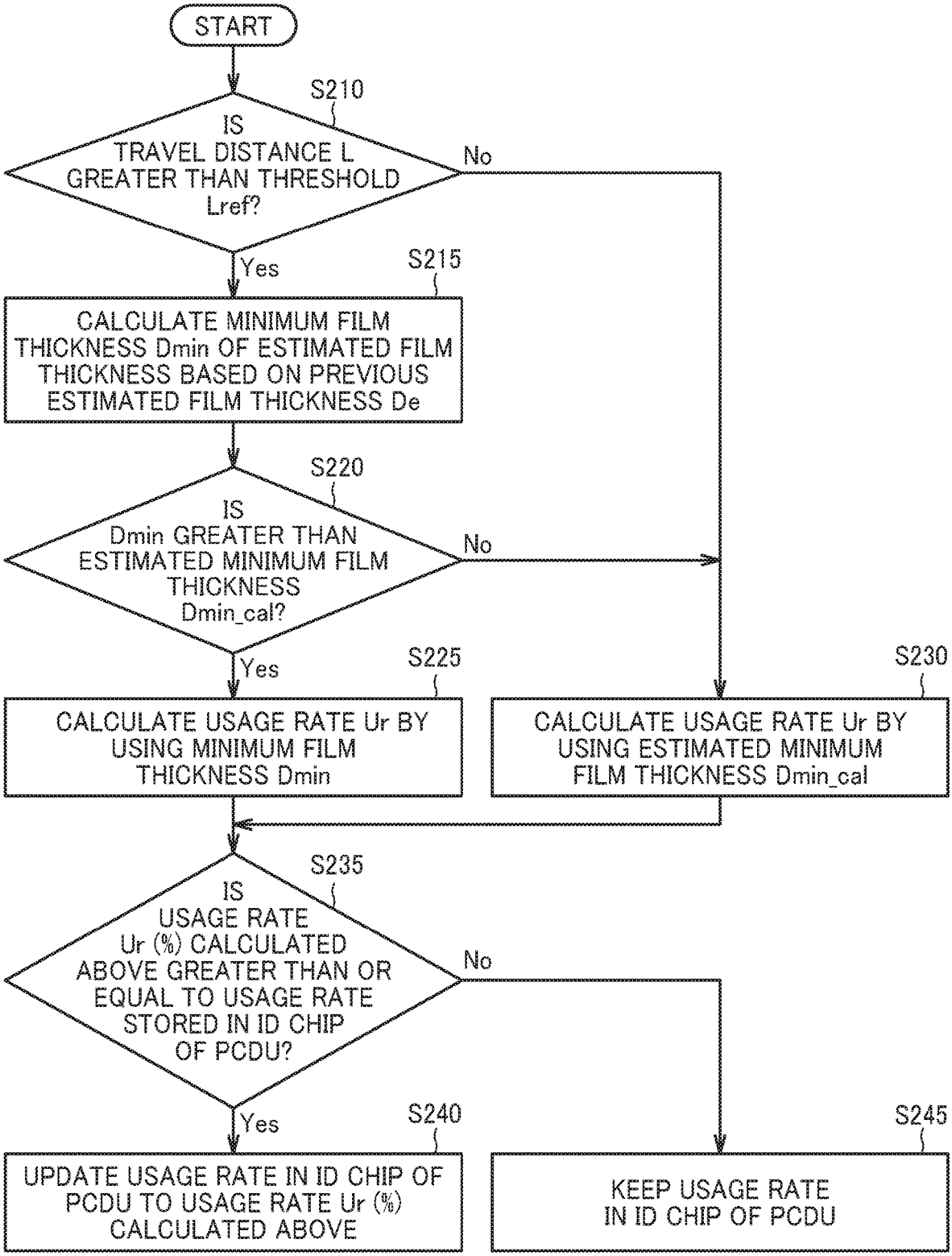
FIG. 13 is a flowchart illustrating the usage rate calculation process of the image forming apparatus according to the second embodiment of the present disclosure.

FIG. 13 is a flowchart illustrating the usage rate calculation process of the image forming apparatus 1 according to the second embodiment of the present disclosure.

In step S210, the comparison unit 30*k* determines whether the travel distance L of the photoconductor 6 is larger than the predetermined threshold value Lref.

When the travel distance L of the photoconductor 6 is larger than the predetermined threshold value Lref, in step S215, the film thickness range estimation unit 30*d* calculates the film thickness range lower limit value Dmin based on the previous estimated film thickness De.

That is, the film thickness range estimation unit 30*d* subtracts a value obtained by multiplying the maximum wear speed Vsmax by a travel distance (Ln−Le) from the previous film thickness estimation time from the value obtained by subtracting the estimated film thickness error ΔDe from the estimated film thickness De to calculate the film thickness range lower limit Dmin as follows.

$$Dmax=De-\Delta De-Vsmax\times(Ln-Le) \quad (14)$$

The estimated film thickness error ΔDe is calculated by subtracting the present estimated film thickness De from the previous estimated film thickness De.

The film thickness range estimation unit 30*d* calculates the film thickness range from Dmin to Dmax corresponding to the present travel distance L by using the estimated film thickness error ΔDe based on the previous estimated film thickness. Since decrease of the thickness of the photoconductor film 6*a* of the photoconductor 6 leads to decreases of the estimated film thickness error ΔDe, the estimation accuracy of the film thickness range from Dmin to Dmax is improved.

In step S220, the comparison unit 30*k* determines whether the film thickness range lower limit value Dmin is larger than the maximum wearing film thickness.

When the film thickness range lower limit value Dmin is greater than the estimated minimum film thickness Dmin_cal, that is, in the range 64 in FIG. 12, the usage rate calculator 30*g* calculates the usage rate Ur by using the film thickness range lower limit value Dmin in step S225.

That is, the usage rate calculator 30*g* calculates the usage rate Ur of the photoconductor 6 based on the film thickness range lower limit value Dmin (the expression (14)) estimated by the film thickness range estimation unit 30*d*. The usage rate calculator 30*g* calculates the usage rate as a rate of the abrasion amount (Ds−Dmin) from the initial film thickness and an allowed abrasion amount (Ds−Dref) (Dref means the film thickness for avoiding the abnormal image).

$$Ur=(Ds-D\mathrm{min})\div(Ds-Dref)\times 100 \quad (15)$$

The usage rate calculator 30*g* calculates the usage rate of the photoconductor 6 based on the film thickness range lower limit value Dmin. This improves the accuracy of the usage rate calculation.

The usage rate calculator 30*g* calculates the usage rate of the photoconductor 6 based on the film thickness range lower limit value Dmin after the travel distance L of the photoconductor 6 calculated by the travel distance calculator 30*h* exceeds the predetermined threshold value. This improves the accuracy of the usage rate estimation of the photoconductor 6.

On the other hand, when the travel distance L of the photoconductor 6 is not greater than the threshold Lref (No in step S210), or when the film thickness range lower limit value Dmin is not greater than the estimated minimum film thickness Dmin_cal, that is, in the range 65 in FIG. 12, the usage rate calculator 30*g* calculates the usage rate Ur of the photoconductor 6 by using the estimated minimum film thickness Dmin_cal in step S230.

$$Ur=(Ds-D\mathrm{min}_cal)\div(Ds-Dref)\times 100 \quad (16)$$

The usage rate calculator 30*g* calculates the usage rate of the photoconductor 6 based on the larger of the film thickness range lower limit value Dmin and the estimated minimum film thickness Dmin_cal, but, when the calculated usage rate Ur lowers the usage rate already recorded in ID chip of a process cartridge (PCDU), a user may be confused by decrease of the usage rate. Therefore, the usage rate calculator 30*g* compares the calculated usage rate Ur with the usage rate already recorded in the ID chip in step S235. When the calculated usage rate Ur is greater than or equal to the usage rate stored in the ID chip, the usage rate calculator 30*g* updates the usage rate in the ID chip of the PCDU to the calculated usage rate Ur in step S240. When the calculated usage rate Ur is smaller than the usage rate stored in the ID chip, the usage rate calculator 30*g* does not update the usage rate in the ID chip of the PCDU, that is, keep the usage rate in the ID chip in step S245 to avoid user confusion caused by decrease of the usage rate.

<Effect of Second Embodiment>

In the second embodiment, to determine whether the calculated Dc is normal or abnormal, the control device 10 stores the travel distance L of the photoconductor and the estimated film thickness De in the past film thickness estimation and calculates the intercept β and the slope α of the film thickness versus the travel distance L of the photoconductor. Based on these calculations, the film thickness estimation unit 30*c* can obtain the estimated film thickness De assumed from the travel distance L of the photoconductor.

When the control device 10 determines that the photoconductor 6 is spent, the film thickness range estimation unit 30*d* calculates the film thickness range lower limit value Dmin that is the lower limit value in the range in which the film thickness can be calculated based on the latest estimated film thickness De and the estimated film thickness error ΔDe based on the estimated film thickness De.

Using this lower limit value, the control device 10 calculates the usage rate Ur and determines the end of life. The film thickness range lower limit value Dmin is based on the previous estimated film thickness De. As the travel distance L of the photoconductor 6 increases and the film becomes thinner, the calculation of the usage rate Ur becomes more accurate. Therefore, calculating the range in which the film thickness may be taken based on the estimated film thickness De gives the high accurate usage rate Ur of the photoconductor.

Third Embodiment

<Controller>

Figure 14:
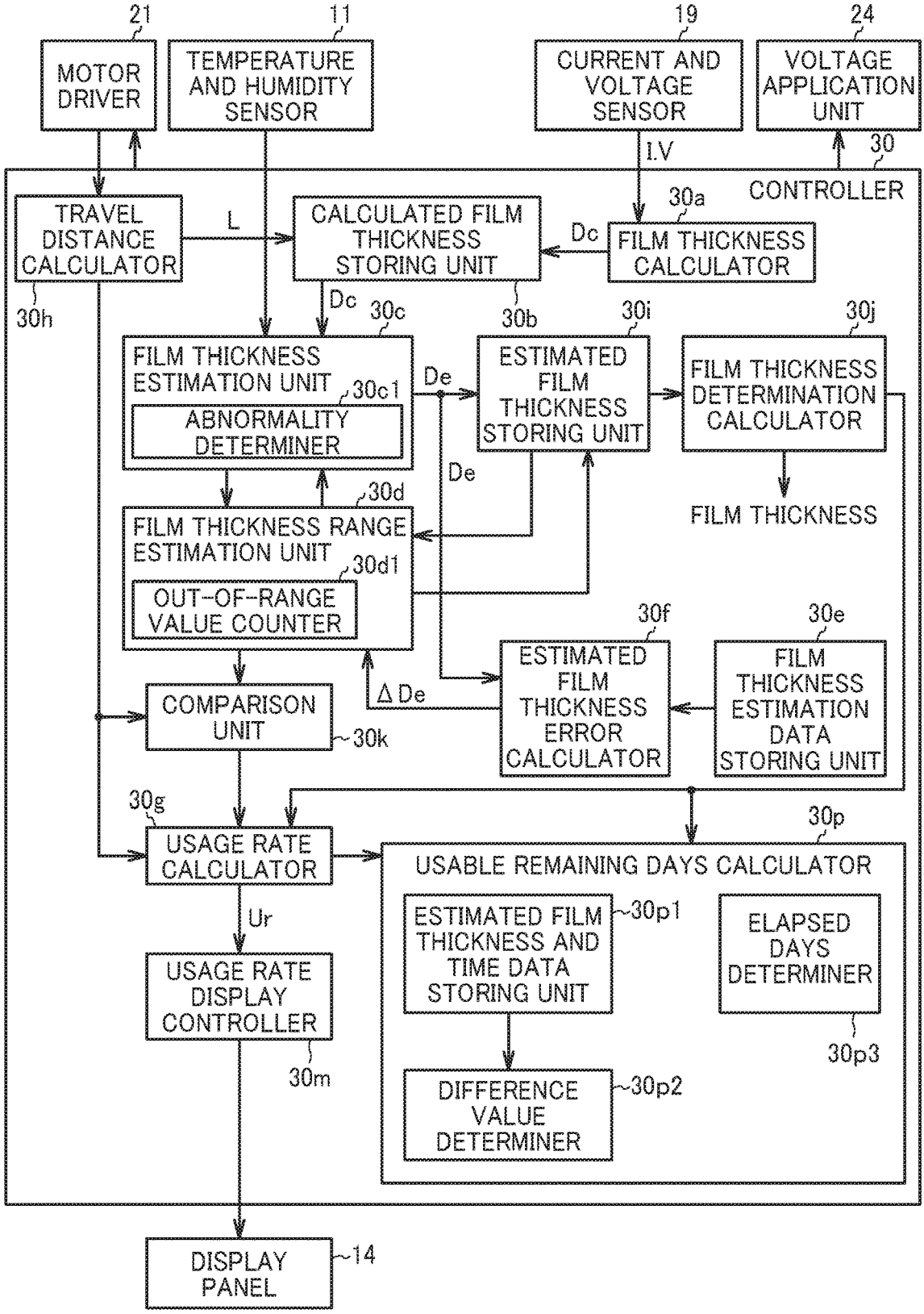
FIG. 14 is a functional block diagram illustrating a configuration of a control device of the image forming apparatus according to a third embodiment of the present disclosure.

FIG. 14 is a functional block diagram illustrating a configuration of the controller 30 according to the third embodiment of the present disclosure. Among the reference numbers illustrated in FIG. 14, the same reference numbers as those illustrated in FIG. 3 have the same configuration. Therefore, a description thereof is omitted.

The controller 30 according to the third embodiment includes a usable remaining days calculator 30*p*, an estimated film thickness and time data storing unit 30*p*1, a difference value determiner 30*p*2, and an elapsed days determiner 30*p*3.

Based on the film thickness range lower limit value, the usable remaining days calculator 30*p* calculates usable remaining days of the photoconductor 6.

The usable remaining days calculator 30*p* calculates the usable remaining days of the photoconductor 6 based on the present film thickness calculated by the film thickness estimation unit 30*c*, present time data, and time data and an estimated film thickness when the travel distance of the photoconductor 6 obtained from the estimated film thickness and time data storing unit 30*p*1 becomes greater than a predetermined threshold.

The usable remaining days calculator 30*p* calculates the usable remaining days of the photoconductor 6 based on the present film thickness calculated by the film thickness estimation unit 30*c*, the present time data, and an estimated film thickness and time data when the estimated film thickness of the photoconductor 6 obtained from the estimated film thickness and time data storing unit 30*p*1 becomes smaller than or equal to a predetermined threshold.

The usable remaining days calculator 30*p* calculates the usable remaining days of the photoconductor 6 when the difference value determiner 30*p*2 determines that a difference value of the estimated film thickness from a predetermined time to the present time is greater than or equal to a predetermined threshold.

The usable remaining days calculator 30*p* calculates the usable remaining days of the photoconductor 6 when the elapsed days determiner 30*p*3 determines that a number of elapsed days from a predetermined time to the present time is greater than or equal to a predetermined threshold.

The estimated film thickness and time data storing unit 30*p*1 stores the estimated film thickness and time data when the travel distance of photoconductor 6 calculated by the travel distance calculator 30*h* is greater than a predetermined threshold.

The difference value determiner 30*p*2 determines whether the difference value of the estimated film thickness from the predetermined time to the present time becomes equal to or greater than the predetermined threshold.

The elapsed days determiner 30*p*3 determines whether the number of elapsed days from the predetermined time to the present time becomes greater than or equal to the predetermined threshold.

<Outline of Usable Remaining Days Calculation Process>

The usable remaining days calculator 30*p* calculates the usable remaining days of the photoconductor 6 based on the estimated film thickness De and the usage rate Ur described above. Calculating the usable remaining days by the usable remaining days calculator 30*p* makes it easy for the user or a customer engineer to know an approximate period until the user or the customer engineer prepares a new photoconductor 6.

Based on an equation (17), the usable remaining days calculator 30*p* subtracts the usage rate Ur (%) from 100%, divides the calculated value (100−Ur (%)) by a value (Ur (%)÷Du) obtained by dividing the usage rate Ur (%) by a number of days used Du from a day in which the photoconductor 6 is exchanged to the present time to calculate the usable remaining days Dl.

$$Dl=(100-Ur(\%))\div(Ur(\%)\div Du) \quad (17)$$

Based on an equation (18), the usable remaining days calculator 30*p* subtracts the present estimated film thickness De from the initial film thickness Ds, divides the calculated value (Ds−De) by the value (Ds−Dref) obtained by subtracting the threshold Dref from the initial film thickness Ds, and further multiplies the calculated value (Ds−De)/(Ds−Dref) by 100 to calculate the usage rate Ur [%].

$$Ur[\%]=(Ds-De)/(Ds-Dref)\times 100 \quad (18)$$

Based on an equation (19), the usable remaining days calculator 30*p* subtracts a threshold Deref from the present film thickness De, and divides the calculated value (De−Deref) by the value ((Ds−De)÷Du) obtained by subtracting the present estimated film thickness De from the initial film thickness Ds and dividing the calculated value (Ds−De) by the number of days used Du from the day in which the photoconductor 6 is exchanged to the present time to calculate the usable remaining days.

$$Dl=(De-Deref)\div((Ds-De)\div Du) \quad (19)$$

In a comparative example, the usage remaining days Dl is calculated based on the travel distance L of the photoconductor 6 or a number of printed sheets Np as described below.

In the comparative example, based on an equation (20), the usable remaining days calculator 30*p* subtracts the present travel distance L of the photoconductor from a travel distance Ld at an exchange timing of the photoconductor and divides the calculated value (Ld−L) by the value (L÷Du) obtained by dividing the preset travel distance L of the photoconductor by the number of days Du from a day in which the photoconductor 6 is exchanged to the present time to calculate the usable remaining days Dl.

$$Dl=(Ld-L)\div(L\div Du) \quad (20)$$

Or, in the comparative example, based on an equation (21), the usable remaining days calculator 30*p* subtracts a present number of printed sheets Np from a number of printed sheets NI at the exchange timing and divides the calculated value (Nl−Np) by the value obtained by dividing a present number of printed sheets Np by the number of days Du from a day in which the photoconductor 6 is exchanged to the present time to calculate the usable remaining days Dl.

$$Dl=(Nl-Np)\div(NP\div Du) \quad (21)$$

Since the travel distance Ld and the number of printed sheets Nl at the exchange timing is set to a value having a margin with respect to the photoconductor film thickness D at the end of life of the photoconductor, in practice, the photoconductor 6 can be used longer.

Calculating the usage rate Ur based on the estimated film thickness De described above and calculating the usable remaining days Dl based on the usage rate Ur associates the usage remaining days Dl with the film thickness. This makes it possible to improve the accuracy of the usable remaining days Dl.

<Travel Distance and Film Thickness of Photoconductor>

Figure 15:
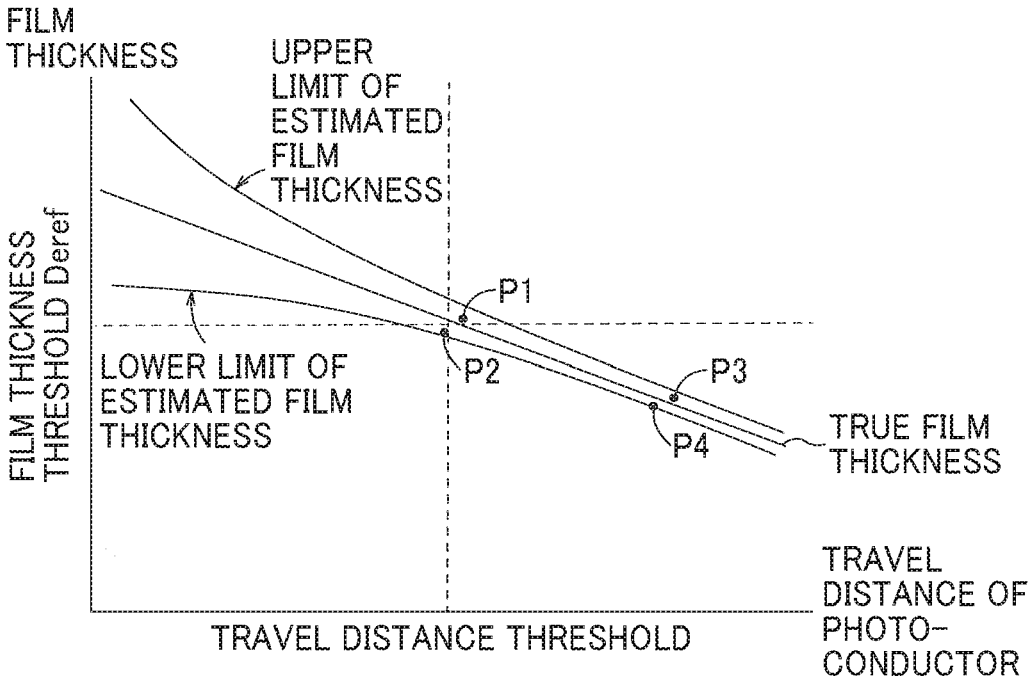
FIG. 15 is a graph illustrating a relation between a travel distance of the photoconductor and the film thickness.

FIG. 15 is a graph illustrating a relation between the travel distance L of the photoconductor 6 and the film thickness D.

As illustrated in FIGS. 8 and 15, in the initial state of the photoconductor, that is, when the film thickness D of the photoconductor is thick, and when the travel distance of the photoconductor is short, the range of the estimated film thickness De becomes wide as illustrated in FIG. 15, which decreases the accuracy of the estimated film thickness De.

Therefore, calculating the usable remaining days Dl after the film is scraped and the film thickness D becomes thin improves the calculation accuracy of the usable remaining days Dl.

Based on an equation (22), the usable remaining days calculator 30*p* subtracts a threshold Dref from the present estimated film thickness De, and divides the calculated value (De−Dref) by the value ((Det−De)÷Dp) obtained by subtracting the present estimated film thickness De from the estimated film thickness Det when the travel distance L exceeds a predetermined value such as a point P3 in FIG. 15 and dividing the calculated value (Det−De) by a number of days Dp from a day when the travel distance L exceeds the predetermined value to the present time to calculate the usable remaining days Dl.

$$Dl=(De-Dref)\div((Det-De)\div Dp) \quad (22)$$

When the usable remaining days calculator 30*p* obtains the usable remaining days Dl based on the equation (22), the usable remaining days Dl is predicted based on high accurate data among the estimated film thickness De.

Due to a determination result of an estimated film thickness difference ΔDe by the difference value determiner 30*p*2, which is described later, based on an equation (23), the usable remaining days calculator 30*p* subtracts a threshold Dref from the present estimated film thickness De, and divides the calculated value (De−Dref) by the value ((Del−D)÷Dp) obtained by subtracting the estimated film thickness Del when the estimated film thickness De becomes smaller than or equal to a predetermined value such as a point P4 in FIG. 15 from the present estimated film thickness De and dividing the calculated value (Del−D) by a number of days Dp from a day when the estimated film thickness becomes a predetermined film thickness D to the present time to calculate the usable remaining days Dl.

$$Dl=(De-Dref)\div((Del-D)\div Dp) \quad (23)$$

When the usable remaining days calculator 30*p* obtains the usable remaining days Dl based on the equation (23), the usable remaining days Dl is predicted based on high accurate data among the estimated film thickness De.

<Estimated Film Thickness Difference Value>

Based on an equation (24), the difference value determiner 30*p*2 subtracts a present estimated film thickness Detn from an estimated film thickness Detl when the travel distance L of the photoconductor exceeds a predetermined value to calculate the estimated film thickness difference ΔDe.

$$\Delta De=(Detl-Detn) \quad (24)$$

The difference value determiner 30*p*2 determines whether the estimated film thickness difference ΔDe from the predetermined time when the travel distance L of the photoconductor exceeds a predetermined value to the present time becomes equal to or greater than the predetermined threshold.

Or, based on an equation (25), the difference value determiner 30*p*2 subtracts a present estimated film thickness De from a predetermined film thickness De to calculate the estimated film thickness difference ΔDe.

$$\Delta De=(D-De) \quad (25)$$

The difference value determiner 30*p*2 determines whether the estimated film thickness difference ΔDe from the predetermined time when the travel distance L of the photoconductor exceeds a predetermined value to the present time becomes equal to or greater than the predetermined threshold.

Preferably, the usable remaining days calculator 30*p* calculates the usable remaining days Dl based on the estimated film thickness when the estimated film thickness De becomes smaller than the threshold Deref because an estimation of a film wear rate that is a film wear amount in a day tends to include an error when the estimated film thickness difference ΔDe calculated by the equation (24) or the equation (25) is a certain level of large amount.

For the same reason, the elapsed days determiner 30*p*3 determines whether the number of elapsed days from the predetermined time to the present time is greater than or equal to the predetermined threshold.

Preferably, the usable remaining days Dl is calculated after the number of days Dp from the day when the travel distance L exceeds the predetermined value to the present time or the number of days Dp from when the estimated film thickness De is a predetermined film thickness to the present time exceeds a predetermined threshold Dpref.

<Effect of Third Embodiment>

The usable remaining days Dl of the photoconductor 6 which the usable remaining days calculator 30*p* calculates based on the estimated film thickness range lower limit value is more accurate than the usable remaining days Dl of the photoconductor 6 calculated from the number of printed sheets or the travel distance data.

The calculation of the usable remaining days Dl of the photoconductor 6 based on the present estimated film thickness calculated by the film thickness estimation unit 30*c*, the present time data, and the estimated film thickness and time data when the travel distance of the photoconductor obtained from the estimated film thickness and time data storing unit 30*p*1 is greater than the predetermined threshold improves accuracy of estimation of the film wear rate and the usable remaining days Dl.

The calculation of the usable remaining days of the photoconductor 6 based on the present film thickness calculated by the film thickness estimation unit 30*c*, the present time data, and the estimated film thickness and the time data when the estimated film thickness of the photoconductor 6 obtained from the estimated film thickness and time data storing unit 30*p*1 is smaller than or equal to the predetermined threshold improves accuracy of estimation of the film wear rate and the usable remaining days Dl.

The calculation of the usable remaining days of the photoconductor 6 when the estimated film thickness difference ΔDe from the predetermined time to the present time is determined greater than or equal to the predetermined threshold reduces the influence of measurement error and improves the accuracy of estimation of the usable remaining days Dl.

The calculation of the usable remaining days of the photoconductor 6 when the number of elapsed days from the predetermined time to the present time is determined greater than or equal to the predetermined threshold reduces the influence of measurement error and improves the accuracy of estimation of the usable remaining days Dl.

<Summary of Aspects of Present Embodiment>

First Aspect

The image forming apparatus 1 in the first aspect includes the voltage application unit 24 to apply the charging bias to the charging roller 12 that charges the surface of the rotating photoconductor 6, the current and voltage sensor 19 to generate the feedback signal representing the output current flowing from the charging roller 12 to the photoconductor 6, the film thickness calculator 30*a* to calculate the thickness of the photoconductor film 6*a* of the photoconductor 6 based on the voltage V of the charging bias applied to the charging roller 12 and the output current I flowing to the photoconductor 6, the travel distance calculator 30*h* to calculate the travel distance L of the photoconductor 6 charged, the calculated film thickness storing unit 30*b* that associates the calculated film thickness Dc which is calculated by the film thickness calculator 30*a* with a travel distance L and stores the calculated film thickness Dc and the travel distance L, the film thickness estimation unit 30*c* to calculate the present estimated film thickness based on the calculated film thicknesses and the travel distances at the plurality of points of time acquired from the calculated film thickness storing unit 30*b*, and the film thickness range estimation unit 30*d* to calculate the film thickness range from Dmin to Dmax, which corresponds to the present travel distance L, based on the estimated film thickness De calculated by the film thickness estimation unit 30*c*.

In the first aspect, the calculation of the film thickness range from Dmin to Dmax corresponding to the present travel distance L based on the estimated film thickness De can lead to the high accurate calculation of the film thickness range.

Second Aspect

The film thickness estimation unit 30*c* in the second aspect calculates the estimated film thickness corresponding to the present travel distance using the least square method based on the calculated film thicknesses Dc and the travel distances L at the plurality of points of time acquired from the calculated film thickness storing unit 30*b*.

In the second aspect, calculating the estimated film thickness corresponding to the present travel distance using the least square method based on the calculated film thicknesses Dc and the travel distances L at the plurality of points of time improves the estimation accuracy of the estimated film thickness De.

Third Aspect

The film thickness estimation unit 30*c* in the third aspect includes the abnormality determiner 30*c*1 that determines whether the estimated film thickness De is valid or invalid in the next film thickness estimation based on whether the estimated film thickness De falls within the film thickness range from Dmin to Dmax estimated by the film thickness range estimation unit 30*d*.

In the third aspect, determining whether the estimated film thickness De is valid or invalid based on whether the estimated film thickness De falls within the film thickness range from Dmin to Dmax in the next film thickness estimation improves the accuracy of the estimated film thickness De, which can improve the accuracy of the next film thickness estimation.

Forth Aspect

The image forming apparatus in the fourth aspect includes the film thickness estimation data storing unit 30*e* to store the film thickness error estimation data and the estimated film thickness error calculator 30*f* to calculate the estimated film thickness error ΔDe at the estimated film thickness based on the film thickness error estimation data and the estimated film thickness. The film thickness range estimation unit 30*d* in the fourth aspect calculates the film thickness range from Dmin to Dmax based on the estimated film thickness De and the estimated film thickness error ΔDe.

The film thickness range estimation unit 30*d* in the fourth aspect calculates the film thickness range from Dmin to Dmax based on the estimated film thickness De and the estimated film thickness error ΔDe. This causes the small estimated film thickness error ΔDe in the film thickness estimation when the estimated film thickness De is thin and gives advantage that the estimation accuracy of the film thickness range Dmin to Dmax is improved.

Fifth Aspect

The film thickness range estimation unit 30*d* in the fifth aspect calculates the film thickness range from Dmin to Dmax to be narrower as the previous estimated film thickness value is smaller.

The above calculation causes the small estimated film thickness error ΔDe in the film thickness estimation when the estimated film thickness De is thin and gives advantage that the estimation accuracy of the film thickness range Dmin to Dmax is improved.

Sixth Aspect

The image forming apparatus in the sixth aspect includes the temperature and humidity sensor 11 to detect the present temperature and humidity, and the film thickness estimation unit 30*c* collects the estimated film thickness De based on based on the temperature and humidity detected by the temperature and humidity sensor 11.

In the sixth aspect, correction of the estimated film thickness De based on the temperature and humidity gives an advantage that the estimation accuracy of the estimated film thickness De is improved.

Seventh Aspect

The image forming apparatus in the seventh aspect includes the temperature and humidity sensor 11 to detect the present temperature and humidity, and the film thickness estimation unit 30*c* collects the estimated film thickness error ΔDe based on based on the temperature and humidity detected by the temperature and humidity sensor 11.

In the seventh aspect, correction of the estimated film thickness error ΔDe based on the temperature and humidity gives an advantage that the estimation accuracy of the estimated film thickness De is improved.

Eighth Aspect

The abnormality determiner 30*c*1 in the eighth aspect determines that the estimated film thickness De is invalid when the estimated film thickness De is greater than the film thickness range higher limit value Dmax in the film thickness range from Dmin to Dmax estimated by the film thickness range estimation unit 30*d*.

This prevents the disadvantage due to the abnormal image that is caused by wrong determination regarding the end of life of the photoconductor.

Ninth Aspect

The abnormality determiner 30*c*1 in the ninth aspect includes the out-of-range value counter 30*d*1 that counts the out-of-range count that is counted when the estimated film thickness De which is estimated by the film thickness estimation unit 30*c* is smaller than the film thickness range lower limit value Dmin in the film thickness range from Dmin to Dmax estimated by the film thickness range estimation unit 30*d*. The abnormality determiner 30*c*1 determines that the estimated film thicknesses De smaller than the film thickness range lower limit value Dmin is valid when the out-of-range count continuously counted by the out-of-range value counter 30*d*1 becomes equal to or greater than a predetermined number of times.

In the ninth aspect, the abnormality determiner 30*c*1 determines that the film of the photoconductor 6 is really scraped off when the film thickness estimation unit 30*c* continuously estimates the estimated film thicknesses De smaller than the film thickness range lower limit value Dmin. This determination causes this control to avoid the occurrence of the abnormal image, which means a safety side control.

Tenth Aspect

In the tenth aspect, when the estimated film thicknesses De becomes valid, the abnormality determiner 30*c*1 discards the calculated film thickness stored in the calculated film thickness storing unit 30*b* before the estimated film thickness becomes smaller than the film thickness range lower limit value Dmin.

This discard prevents the result that the estimated film thickness calculated based on the past calculated film thicknesses Dc becomes a thick film thickness.

Eleventh Aspect

The abnormality determiner 30*c*1 in the eleventh aspect includes the out-of-range value counter 30*d*1 to count the out-of-range count when the estimated film thickness is greater than the film thickness range higher limit value Dmax in the film thickness range from Dmin to Dmax estimated by the film thickness range estimation unit 30*d* or when the estimated film thickness is smaller than the film thickness range lower limit value Dmin in the film thickness range from Dmin to Dmax estimated by the film thickness range estimation unit 30*d*. When the out-of-range count continuously counted by the out-of-range value counter 30*d*1 is less than the predetermined number of times, the abnormality determiner 30*c*1 in the eleventh aspect causes the film thickness estimation unit 30*c* to perform the film thickness estimation process again.

This enables to early determine whether the abnormality in the estimated film thickness De is true or not.

Twelfth Aspect

The abnormality determiner 30*c*1 in the twelfth aspect includes the out-of-range value counter 30*d*1 that counts the out-of-range count when the estimated film thickness De which is estimated by the film thickness estimation unit 30*c* is out of the film thickness range from Dmin to Dmax estimated by the film thickness range estimation unit 30*d*. In image formation control, the abnormality determiner 30*c*1 in the twelfth aspect does not use the estimated film thickness which is estimated by the film thickness estimation unit 30*c* when the out-of-range count continuously counted by the out-of-range value counter 30*d*1 becomes equal to or greater than the predetermined number of times.

This avoids the disadvantage of occurrence of an abnormal state that is caused by use of the invalid estimated film thicknesses.

Thirteenth Aspect

The image forming apparatus 1 in the thirteenth aspect includes the usage rate calculator 30*g* to calculate the usage rate of the photoconductor 6 based on the film thickness range lower limit value estimated by the film thickness range estimation unit 30*d*.

This improves the accuracy of the usage rate calculation.

Fourteenth Aspect

The image forming apparatus 1 in the fourteenth aspect includes the travel distance calculator 30*h* to calculate the travel distance L of the photoconductor 6 and the comparison unit 30*k* to compare the film thickness range lower limit value Dmin estimated by the film thickness range estimation unit 30*d* and the maximum wearing film thickness when the photoconductor film 6*a* that can be calculated based on the travel distance of the photoconductor 6 is scraped to the maximum. The usage rate calculator 30*g* calculates the usage rate of the photoconductor 6 based on the larger of the film thickness range lower limit value Dmin and the maximum scrape film thickness value.

In the fourteenth aspect, the usage rate calculator 30*g* calculates the usage rate of the photoconductor 6 based on the larger of the film thickness range lower limit value Dmin and the maximum wearing film thickness, but, when the calculated usage rate Ur lowers the usage rate already recorded in ID data of a process cartridge, the usage rate already recorded in the ID data is kept and is not updated to avoid user confusion caused by decrease of the usage rate.

Fifteenth Aspect

The film thickness range estimation unit 30*d* in the fifteenth aspect calculates the film thickness range lower limit value Dmin corresponding to the present travel distance L by using the estimated film thickness error ΔDe based on the previous estimated film thickness.

In the fifteenth aspect, since decrease of the thickness of the photoconductor film 6*a* of the photoconductor 6 leads to decreases of the estimated film thickness error ΔDe, the estimation accuracy of the film thickness range lower limit value Dmin is improved.

Sixteenth Aspect

The usage rate calculator 30*g* in the sixteenth aspect calculates the usage rate of the photoconductor 6 based on the film thickness range lower limit value Dmin which is estimated by the film thickness range estimation unit 30*d* after the travel distance L of the photoconductor 6 calculated by the travel distance calculator 30*h* exceeds the predetermined threshold value.

This improves the accuracy of the usage rate estimation of the photoconductor 6.

Seventeenth Aspect

The image forming apparatus 1 in the seventeenth aspect includes the usable remaining days calculator 30*p* to calculate the usable remaining days of the photoconductor based on the estimated film thickness range lower limit value.

The usable remaining days Dl of the photoconductor 6 which the usable remaining days calculator 30*p* in the seventeenth aspect calculates based on the estimated film thickness range lower limit value is more accurate than the usable remaining days Dl of the photoconductor 6 calculated from the number of printed sheets or the travel distance data.

Eighteenth Aspect

The image forming apparatus 1 in the eighteenth aspect includes the estimated film thickness and time data storing unit 30*p*1 to store the estimated film thickness and the time data when the travel distance of the photoconductor calculated by the travel distance calculator 30*h* becomes greater than the predetermined threshold. The usable remaining days calculator 30*p* calculates the usable remaining days Dl of the photoconductor 6 based on the present film thickness calculated by the film thickness estimation unit 30*c*, present time data, an estimated film thickness and the time data when the travel distance of the photoconductor 6 obtained from the estimated film thickness and time data storing unit 30*p*1 becomes greater than a predetermined threshold.

In the eighteenth aspect, the calculation of the usable remaining days Dl of the photoconductor 6 based on the present estimated film thickness calculated by the film thickness estimation unit 30*c*, the present time data, and the estimated film thickness and time data when the travel distance of the photoconductor obtained from the estimated film thickness and time data storing unit 30*p* becomes greater than the predetermined threshold improves accuracy of estimation of the film wear rate and the usable remaining days Dl.

Nineteenth Aspect

The image forming apparatus 1 in the nineteenth aspect includes the estimated film thickness and time data storing unit 30*p*1 to store the estimated film thickness and the time data when the estimated film thickness becomes smaller than or equal to the predetermined threshold. The usable remaining days calculator 30*p* calculates the usable remaining days Dl of the photoconductor 6 based on the present film thickness calculated by the film thickness estimation unit 30*c*, present time data, an estimated film thickness when the estimated film thickness of the photoconductor 6 obtained from the estimated film thickness and time data storing unit 30*p*1 becomes smaller than or equal to a predetermined threshold, and time data when the estimated film thickness of the photoconductor 6 obtained from the estimated film thickness and time data storing unit 30*p*1 is smaller than or equal to a predetermined threshold.

In the nineteenth aspect, the calculation of the usable remaining days of the photoconductor 6 based on the present film thickness calculated by the film thickness estimation unit 30*c*, the present time data, and the estimated film thickness and the time data when the estimated film thickness of the photoconductor 6 obtained from the estimated film thickness and time data storing unit 30*p*1 is smaller than or equal to the predetermined threshold improves accuracy of estimation of the film wear rate and the usable remaining days Dl.

Twentieth Aspect

The image forming apparatus 1 in the twentieth aspect includes the difference value determiner 30*p*2 to determine whether the estimated film thickness difference ΔDe from the predetermined time to the present time is equal to or greater than the predetermined threshold. The usable remaining days calculator 30*p* calculates the usable remaining days Dl of the photoconductor 6 when the difference value determiner 30*p*2 determines that the estimated film thickness difference ΔDe from the predetermined time to the present time is greater than or equal to the predetermined threshold.

In the twentieth aspect, the calculation of the usable remaining days of the photoconductor 6 when the estimated film thickness difference ΔDe from the predetermined time to the present time is determined greater than or equal to the predetermined threshold reduces the influence of measurement error and improves the accuracy of estimation of the usable remaining days Dl.

Twenty-First Aspect

The image forming apparatus in the twenty-first aspect includes the elapsed days determiner 30*p*3 to determine whether the number of elapsed days from the predetermined time to the present time is greater than or equal to the predetermined threshold. The usable remaining days calculator 30*p* calculates the usable remaining days Dl of the photoconductor 6 when the elapsed days determiner 30*p*3 determines that the number of elapsed days from the predetermined time to the present time is greater than or equal to the predetermined threshold.

In the twenty-first aspect, the calculation of the usable remaining days Dl of the photoconductor 6 when the number of elapsed days from the predetermined time to the present time is determined greater than or equal to the predetermined threshold reduces the influence of measurement error and improves the accuracy of estimation of the usable remaining days Dl.

Twenty-Second Aspect

In the twenty-second aspect, an image forming method of the image forming apparatus including the voltage application unit 24 to apply the charging bias to the charging roller 12 that charges the surface of the rotating photoconductor 6 and the current and voltage sensor 19 to generate the feedback signal representing the output current flowing from the charging roller 12 to the photoconductor 6 includes calculating the thickness of the photoconductor film 6*a* of the photoconductor 6 based on the voltage of the charging bias applied to the charging roller 12 and the output current flowing to the photoconductor 6, calculating the mileage L of the photoconductor 6 charged, associating the calculated film thickness Dc with the mileage L, storing the calculated film thickness Dc and the mileage L, calculating the present estimated film thickness De based on the calculated film thicknesses Dc and the mileages that are stored at the plurality of points of time, and calculating the film thickness range from Dmin to Dmax, which corresponds to the present mileage L, based on the estimated film thickness De.

An effect in the twenty-second aspect is similar to the one in the first aspect, and redundant description is omitted.

Twenty-third Aspect

In a twenty-third aspect, a non-transitory recording medium stores an image forming program that executes the image forming method in the seventeenth aspect.

In the twenty-third, a processor can execute the image forming method.

It is to be noted that the above embodiment is presented as examples to realize the present disclosure, and it is not intended to limit the scope of the disclosure. These novel embodiments can be implemented in various other forms, and various omissions, substitutions, and changes can be made without departing from the gist of the disclosure. These embodiments and variations are included in the scope and gist of the disclosure and are included in the disclosure described in the claims and the equivalent scope thereof.

The embodiment and variations described above are preferred example embodiments of the present disclosure, and various applications and variations may be made without departing from the scope of the present disclosure. For example, elements and/or features of different illustrative embodiments may be combined with each other and/or substituted for each other within the scope of the present disclosure.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits. A processing circuit includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. An image forming apparatus comprising:

a photoconductor that is rotatable;

a charging roller to charge a surface of the photoconductor;

a power source to apply a charging bias to the charging roller;

a current sensor to generate a signal representing an output current flowing from the charging roller to the photoconductor;

a memory; and circuitry to:

calculate film thicknesses of a photoconductor film of the photoconductor at a plurality of points of time, based on a voltage of the charging bias applied to the charging roller and the signal representing the output current flowing to the photoconductor;

calculate travel distances of the photoconductor charged by the charging roller at the plurality of points of time;

associate the film thicknesses with the travel distances and store the film thicknesses and the travel distances in the memory;

calculate a present estimated film thickness, based on the film thicknesses and the travel distances acquired from the memory; and calculate an estimated film thickness range corresponding to a present travel distance, based on the present estimated film thickness.

2. The image forming apparatus according to claim 1, wherein the circuitry is configured to calculate the present estimated film thickness using a least square method, based on the film thicknesses and the travel distances acquired from the memory.

3. The image forming apparatus according to claim 1, wherein the circuitry is configured to determine whether the present estimated film thickness is valid or invalid in a next film thickness estimation, based on whether the present estimated film thickness falls within the estimated film thickness range.

4. The image forming apparatus according to claim 3, wherein the circuitry is configured to determine that the present estimated film thickness is invalid upon the present estimated film thickness being relatively greater than an upper limit value of the estimated film thickness range.

5. The image forming apparatus according to claim 3, wherein the circuitry is configured to count an out-of-range count that is counted upon the present estimated film thickness being relatively smaller than a lower limit value of the estimated film thickness range, and wherein the circuitry is configured to determine that the present estimated film thickness, relatively smaller than the lower limit value, is valid upon the out-of-range count being continuously counted a predetermined number of times or greater.

6. The image forming apparatus according to claim 5, wherein, upon the circuitry determining that the present estimated film thickness is valid, the circuitry is configured to delete previously stored film thicknesses from the memory, before the present estimated film thickness becomes relatively smaller than the lower limit value of the estimated film thickness range.

7. The image forming apparatus according to claim 3, wherein the circuitry is configured to count an out-of-range count that is counted upon the present estimated film thickness being out of the estimated film thickness range, and wherein the circuitry is configured to not use the present estimated film thickness to estimate a life of the photoconductor upon the out-of-range count being continuously counted a predetermined number of times or greater.

8. The image forming apparatus according to claim 1, wherein the memory is configured to store film thickness error estimation data, wherein the circuitry is configured to calculate an estimated film thickness error at the present estimated film thickness based on the film thickness error estimation data and the present estimated film thickness, and wherein the circuitry is configured to calculate the estimated film thickness range based on the present estimated film thickness and the estimated film thickness error.

9. The image forming apparatus according to claim 1, wherein the circuitry is configured to calculate the estimated film thickness range to be relatively narrower as a previous estimated film thickness value is relatively smaller.

10. The image forming apparatus according to claim 1, further comprising a temperature and humidity sensor to detect temperature and humidity, wherein the circuitry is configured to correct the present estimated film thickness based on the temperature and humidity detected by the temperature and humidity sensor.

11. The image forming apparatus according to claim 1, further comprising a temperature and humidity sensor to detect temperature and humidity, wherein the memory is configured to store film thickness error estimation data, wherein the circuitry is configured to calculate an estimated film thickness error at the present estimated film thickness based on the film thickness error estimation data and the present estimated film thickness, and wherein the circuitry is configured to correct the estimated film thickness error based on the temperature and humidity detected by the temperature and humidity sensor.

12. The image forming apparatus according to claim 1, wherein the circuitry is configured to count an out-of-range count that is counted upon the present estimated film thickness being relatively greater than an upper limit value of the estimated film thickness range and upon the present estimated film thickness being relatively smaller than a lower limit value of the estimated film thickness range, and wherein, before the out-of-range count is continuously counted a predetermined number of times or more, the circuitry is configured to calculate the present estimated film thickness again.

13. The image forming apparatus according to claim 1, wherein the circuitry is configured to calculate a usage rate of the photoconductor based on a lower limit value of the estimated film thickness range.

14. The image forming apparatus according to claim 13, wherein the circuitry is configured to compare the lower limit value of the estimated film thickness range and a maximum wearing film thickness calculated based on a travel distance of the photoconductor, upon the photoconductor film being scraped to a maximum amount; and wherein the circuitry is configured to calculate the usage rate of the photoconductor based on a relatively larger of the lower limit value of the estimated film thickness range and the maximum wearing film thickness.

15. The image forming apparatus according to claim 13, wherein the circuitry is configured to calculate the usage rate of the photoconductor based on the lower limit value of the estimated film thickness range after a travel distance of the photoconductor exceeds a threshold value.

16. The image forming apparatus according to claim 1, wherein the circuitry is configured to calculate the estimated film thickness range corresponding to the present travel distance using an estimated film thickness error based on a previous estimated film thickness.

17. The image forming apparatus according to claim 1, wherein the circuitry includes a usable remaining days calculator, and is configured to use the usable remaining days calculator to calculate usable remaining days of the photoconductor.

18. The image forming apparatus according to claim 17, wherein the circuitry is configured to store an estimated film thickness and time data in the memory upon the travel distance of the photoconductor calculated by the circuitry becoming relatively greater than a threshold, and wherein the circuitry is configured to calculate the usable remaining days of the photoconductor based on the present estimated film thickness calculated by the circuitry, present time data, and the estimated film thickness and time data stored upon the travel distance of the photoconductor obtained from the memory becoming relatively greater than a threshold.

19. An image forming method executable by an image forming apparatus, the apparatus including:

a photoconductor that is rotatable, a charging roller to charge a surface of the photoconductor, a power source to apply a charging bias to the charging roller, and a current sensor to generate a signal representing an output current flowing from the charging roller to the photoconductor, the method comprising:

calculating film thicknesses of a photoconductor film of the photoconductor at a plurality of points of time, based on a voltage of the charging bias applied to the charging roller and the signal representing the output current flowing to the photoconductor;

calculating travel distances of the photoconductor charged by the charging roller at the plurality of points of time;

associating the film thicknesses with the travel distances;

storing the film thicknesses and the travel distances;

calculating a present estimated film thickness based on the film thicknesses and the travel distances; and calculating an estimated film thickness range corresponding to a present travel distance based on the present estimated film thickness.

20. A non-transitory computer-readable recording medium storing an image forming program that, when executed by a computer, causes the computer to execute an image forming method comprising:

generating a signal representing an output current flowing from a charging roller of an image forming apparatus to a photoconductor of the image forming apparatus;

calculating film thicknesses of a photoconductor film of the photoconductor at a plurality of points of time, based on a voltage of a charging bias applied to the charging roller and the signal representing the output current flowing to the photoconductor;

calculating travel distances of the photoconductor charged by the charging roller at the plurality of points of time;

associating the film thicknesses with the travel distances;

storing the film thicknesses and the travel distances;

calculating a present estimated film thickness based on the film thicknesses and the travel distances; and calculating an estimated film thickness range corresponding to a present travel distance based on the present estimated film thickness.

* * * * *